US007222491B2

(12) United States Patent
Moriwaki

(10) Patent No.: US 7,222,491 B2
(45) Date of Patent: May 29, 2007

(54) AIR CONDITIONER AND METHOD FOR PERFORMING OIL EQUALIZING OPERATION IN THE AIR CONDITIONER

(75) Inventor: Shunji Moriwaki, Yokohama (JP)

(73) Assignee: Samsung Electronics Co., Ltd., Suwon-Si (KR)

( * ) Notice: Subject to any disclaimer, the term of this patent is extended or adjusted under 35 U.S.C. 154(b) by 192 days.

(21) Appl. No.: 11/139,987

(22) Filed: May 31, 2005

(65) Prior Publication Data

US 2005/0279111 A1 Dec. 22, 2005

(30) Foreign Application Priority Data

Jun. 10, 2004 (JP) ..... 2004-172560

(51) Int. Cl.
*F25B 43/02* (2006.01)

(52) U.S. Cl. ..... 62/84; 62/117; 62/192; 62/468; 62/470

(58) Field of Classification Search ..... 62/84, 62/117, 192, 193, 324.1, 441, 468, 470
See application file for complete search history.

(56) References Cited

U.S. PATENT DOCUMENTS 3,581,519 A * 6/1971 Garrett et al. ..... 62/468
3,633,377 A * 1/1972 Quick ..... 62/192
4,478,050 A * 10/1984 DiCarlo et al. ..... 62/193
4,589,263 A * 5/1986 DiCarlo et al. ..... 62/193
5,279,131 A * 1/1994 Urushihata et al. ..... 62/324.1
5,490,399 A * 2/1996 Sada ..... 62/510
5,548,968 A * 8/1996 Sada ..... 62/175
5,553,460 A * 9/1996 Isaacs ..... 62/129
5,673,570 A * 10/1997 Sada ..... 62/468
5,996,363 A * 12/1999 Kurachi et al. ..... 62/192
6,604,371 B2 * 8/2003 Ueno ..... 62/193
6,941,767 B2 * 9/2005 Matsuoka et al. ..... 62/470
6,986,259 B2 * 1/2006 Takegami et al. ..... 62/84

FOREIGN PATENT DOCUMENTS

JP 2000-337726 12/2000
JP 2001-336840 A * 12/2001
KR 1996-001602 1/1996

* cited by examiner

*Primary Examiner*—Mohammad M. Ali
(74) *Attorney, Agent, or Firm*—Staas & Halsey LLP

(57) ABSTRACT

An air conditioner including an outdoor unit including a first compressor and a second compressor connected in parallel to the first compressor, an outdoor unit connected in parallel to the outdoor unit, the outdoor unit including a first compressor and a second compressor connected in parallel to the first compressor, the outdoor units being connected in parallel to indoor units, the compressors being connected by first-compressor oil equalizing tubes and second-compressor oil equalizing tubes to feed surplus oil in the compressors, the oil equalizing tubes being connected by an external oil equalizing tube, wherein oil equalization is performed by collecting lubricant oil in the first compressor of the outdoor unit, pressurizing the collected lubricant oil by a discharge pressure of another compressor connected in parallel to the first compressor in the same outdoor unit, that is, the second compressor, and feeding the pressurized lubricant oil into the first compressor or second compressor of the other outdoor unit. Accordingly, it is possible to reduce the oil equalizing operation time. Also, there is no restriction on the length of oil equalizing tubes. Accordingly, an enhancement in reliability is achieved.

17 Claims, 21 Drawing Sheets

AIR CONDITIONER AND METHOD FOR PERFORMING OIL EQUALIZING OPERATION IN THE AIR CONDITIONER

CROSS-REFERENCE TO RELATED APPLICATIONS

This application claims the benefit of Japanese Patent Application No. 2004-172560, filed on Jun. 10, 2004 in the Japanese Patent Office, the disclosure of which is incorporated herein by reference.

BACKGROUND OF THE INVENTION

1. Field of the Invention

The present invention relates to an air conditioner in which a plurality of outdoor units each including a plurality of low-pressure shell type compressors are connected, and a method for performing an oil equalizing operation in the air conditioner.

2. Description of the Related Art

An air conditioner, in which a plurality of outdoor units and a plurality of indoor units are connected in parallel to a refrigerant circuit, is well known. Each of the outdoor and indoor units may include, a plurality of compressors. In such an air conditioner, an oil reservoir is provided in each compressor. The oil reservoirs of the compressors are communicated via oil equalizing tubes so that an oil equalizing operation can be performed to prevent occurrence of a phenomenon that oil is not supplied to one or more of the compressors.

An example of such a structure will be described with reference to FIG. 21. In FIG. 21, "A" designates an outdoor unit of an air conditioner. The outdoor unit A is connected in parallel to another outdoor unit B while being connected in parallel to an indoor unit (not shown). The outdoor unit A includes a first compressor 32*a* and a second compressor 33*a* connected in parallel. The outdoor unit B includes a first compressor 32*b* and a second compressor 33*b* connected in parallel. Refrigerant discharge tubes 39*a* are connected to the compressors 32*a* and 33*a*, respectively. Refrigerant discharge tubes 39*b* are connected to the compressors 32*b* and 33*b*, respectively. The refrigerant discharge tubes 39*a* and 39*b* are joined and then connected to the indoor unit. A refrigerant suction tube extends from the indoor unit to the outdoor units. The refrigerant suction tube is branched into refrigerant suction tubes 40*a*, 41*a*, 40*b*, and 41*b*, which are connected to the compressors 32*a*, 33*a*, 32*b*, and 33*b*, respectively. Each of the compressors 32*a*, 33*a*, 32*b*, and 33*b* is a low-pressure shell type compressor, in which the internal pressure of a compressor shell thereof during operation of the compressor is lower than the internal pressure of the compressor shell in a stopped state of the compressor.

The first and second compressors 32*a* and 33*a* are connected by an oil equalizing tube 43*a* to feed surplus oil between the compressors 32*a* and 33*a*. The first and second compressors 32*b* and 33*b* are connected by an oil equalizing tube 43*b* to feed surplus oil between the compressors 32*b* and 33*b*. The oil equalizing tubes 43*a* and 43*b* are connected by a connecting tube 49.

Bypass tubes 59*a* and 59*b* are branched from respective discharge tubes 39*a* and 39*b* of the compressors 32*a*, 33*a*, 32*b*, and 33*b*. The bypass tubes 59*a* and 59*b* are connected to the suction tubes 40*a*, 41*a*, 40*b*, and 41*b*, respectively. Check valves 45*a* and 45*b* are arranged upstream from respective connections, each of which connects an associated one of the suction tubes 40*a*, 41*a*, 40*b*, and 41*b* and an associated one of the bypass tube 59*a* and 59*b*.

Bypass opening/closing valves 48*a* and 48*b* are arranged at the bypass tubes 59*a* and 59*b*, respectively. The oil equalizing tubes 43*a* and 43*b* are provided with oil equalizing opening/closing valves 46*a* and 46*b* in association with the compressors, respectively.

When an oil equalizing operation is performed during operations of the compressors 32*a*, 33*a*, 32*b*, and 33*b* of the outdoor units A and B by opening, for example, only the bypass opening/closing valve 48*a* of the bypass tube 59*a* connected to the discharge tube 39*a* of the first compressor 32*a* of the outdoor unit A, the discharge pressure of the first compressor 32*a* is applied to the first compressor 32*a*, so that the oil reservoir of the first compressor 32*a* has a pressure higher than those of the remaining compressors. Accordingly, when all the oil equalizing opening/closing valves 46*a* and 46*b* are opened under this condition, lubricant oil in the first compressor 32*a* is supplied into the second compressor 33*a* of the outdoor unit A and the first and second compressors 32*b* and 33*b* of the outdoor unit B. On the other hand, when the bypass opening/closing valves 48*a* and 48*b* are sequentially opened, lubricant oil is supplied into all compressors 32*a*, 33*a*, 32*b*, and 33*b* in equal amounts (Korean Patent laid-open Publication No. 2000-337726).

In the above-mentioned conventional air conditioner, however, the pressure of each oil reservoir is hardly increased because the air conditioner has an arrangement in which an increase in the internal pressures of the compressors is achieved by operating the compressors in an opened state of the bypass opening/closing valves 48*a* and 48*b* to bypass the discharge pressure of each compressor into the same compressor. For this reason, there is a problem in that the oil equalizing operation must be performed for a prolonged period of time to move lubricant oil. Furthermore, there is a restriction that the length of each of the oil equalizing tubes must be short.

Moreover, it is necessary to install the bypass tubes 59*a* and 59*b* and bypass opening/closing valves 48*a* and 48*b* in the discharge tubes 39*a* and 39*b* of all compressors 32*a*, 33*a*, 32*b*, and 33*b* in the outdoor units A and B, respectively. It is also necessary to install the check valves 45*a* and 45*b* in the suction tubes 40*a*, 41*a*, 40*b*, and 41*b* of all of the compressors 32*a*, 33*a*, 32*b*, and 33*b*, respectively. For this reason, the overall arrangement is expensive. Also, there is a problem in that it is difficult to secure a desired reliability because an increased number of constituent elements are used.

SUMMARY OF THE INVENTION

Additional aspects and/or advantages of the invention will be set forth in part in the description which follows and, in part, will be apparent from the description, or may be learned by practice of the invention.

The present invention has been made in view of the above-mentioned problems, and an aspect of the invention is to provide an air conditioner capable of achieving a reduction in oil equalizing operation time, and eliminating a restriction on the length of oil equalizing tubes, and thus, achieving an enhancement in system reliability and a reduction in costs, and to provide a method for performing an oil equalizing operation in the air conditioner.

In accordance with one aspect, the present invention provides an air conditioner including a plurality of outdoor units connected in parallel with an indoor unit, each of the outdoor units including a plurality of compressors connected in parallel, the compressors being connected by an oil equalizing tube to feed surplus oil in each of the compressors to the remaining compressors, and a connecting tube to connect the oil equalizing tubes of the outdoor units, wherein each of the outdoor units further includes a check valve arranged at a suction tube connected to one of the compressors included in each outdoor unit, a bypass tube arranged at an outlet of at least one of the remaining compressors, and a bypass opening/closing valve arranged in the bypass tube, wherein the bypass tube is connected to the suction tube downstream from the check valve, wherein an oil equalizing tube opening/closing valve is arranged in the oil equalizing tube of each outdoor unit to cut off flow of lubricant oil through the oil equalizing tube, and wherein a connecting tube opening/closing valve is arranged in the connecting tube.

The bypass tube, bypass opening/closing valve, and check valve may be installed in only one of the compressors of each outdoor unit.

Each of the compressors may be a low-pressure shell type compressor in which an internal pressure of a shell of the compressor during an operation of the compressor is lower than an internal pressure of the shell in a stopped state of the compressor.

Accordingly, it is possible to feed lubricant oil from one compressor to another compressor connected in parallel to the one compressor by stopping the one compressor.

In accordance with another aspect, the present invention provides a method for performing an oil equalizing operation in an air conditioner including a plurality of outdoor units connected in parallel with an indoor unit, each of the outdoor units including a plurality of compressors connected in parallel, the compressors being connected by an oil equalizing tube to feed surplus oil in each of the compressors to the remaining compressors, and a connecting tube to connect the oil equalizing tubes of the outdoor units, including: collecting lubricant oil in one compressor of one of the outdoor units; pressurizing the collected lubricant oil by a discharge pressure of another compressor, which is connected in parallel to said one compressor in the same outdoor unit; and feeding the pressurized lubricant oil to one compressor of another outdoor unit via an oil equalizing tube and a connecting tube to achieve oil equalization.

Accordingly, it is possible to achieve oil equalization by effectively using the discharge pressure of said another compressor.

In accordance with another aspect, the present invention provides a method for performing an oil equalizing operation in an air conditioner including a plurality of outdoor units connected in parallel with an indoor unit, each of the outdoor units including a plurality of compressors connected in parallel, the compressors being connected by an oil equalizing tube to feed surplus oil in each of the compressors to the remaining compressors, and a connecting tube to connect the oil equalizing tubes of the outdoor units, comprising: collecting lubricant oil in one of the compressors in one of the outdoor units, which can apply, to an oil reservoir in the compressor, a discharge pressure of another compressor in the same outdoor unit; pressurizing the collected lubricant oil by the discharge pressure of said another compressor in the same outdoor unit, and feeding the pressurized lubricant oil to one compressor of another outdoor unit via an oil equalizing tube and a connecting tube; and feeding lubricant oil among the compressors of the same outdoor unit.

Accordingly, it is possible to uniformly supply lubricant oil into all compressors.

Oil equalization may be performed by sequentially supplying lubricant oil into the compressors of the outdoor units by collecting lubricant oil in one of the compressors in one of the outdoor units, which can apply, to an oil reservoir in the compressor, a discharge pressure of another compressor in the same outdoor unit, pressurizing the collected lubricant oil by the discharge pressure of said another compressor in the same outdoor unit, and feeding the pressurized lubricant oil to one compressor of another outdoor unit via an oil equalizing tube and a connecting tube, and feeding lubricant oil among the compressors of the same outdoor unit.

Accordingly, it is possible to achieve oil equalization using a simple operation.

The oil equalization may be performed by incorporating, in a controlled operation of the air conditioner, an oil equalizing operation to sequentially supply lubricant oil into the compressors, the oil equalizing operation including collecting lubricant oil in one of the compressors in one of the outdoor units, which can apply, to an oil reservoir in the compressor, a discharge pressure of another compressor in the same outdoor unit, pressurizing the collected lubricant oil by the discharge pressure of said another compressor in the same outdoor unit, and feeding the pressurized lubricant oil to one compressor of another outdoor unit via an oil equalizing tube and a connecting tube, and feeding lubricant oil among the compressors of the same outdoor unit.

Accordingly, oil equalization can be achieved without the user being aware because it is unnecessary to use detectors during a normal controlled operation.

The oil equalization may be performed, starting from the collection of lubricant oil, when it is detected that an oil level in the oil reservoir of a particular one of the compressors is lower than a predetermined level.

Accordingly, it is possible to efficiently achieve oil equalization because it is possible to reliably supply lubricant oil into compressors, which preferentially require supply of lubricant oil.

In accordance with another aspect, the present invention provides a method for performing an oil equalizing operation in an air conditioner including a plurality of outdoor units connected in parallel with an indoor unit, each of the outdoor units including a plurality of compressors connected in parallel, the compressors being connected by an oil equalizing tube to feed surplus oil in each of the compressors to the remaining compressors, and a connecting tube to connect the oil equalizing tubes of the outdoor units, each of the outdoor units further including a bypass tube connected to a discharge tube of the outdoor unit, the bypass tube communicating with a suction tube of one of the compressors in the outdoor unit only at an outlet of said one compressor, a bypass opening/closing valve arranged in the bypass tube, a check valve arranged at the suction tube upstream from a connection between the bypass tube and the suction tube, an oil equalizing tube opening/closing valve arranged in the oil equalizing tube of the outdoor unit to cut off flow of lubricant oil through the oil equalizing tube, and a connecting tube opening/closing valve arranged in the connecting tube, wherein oil equalization is performed by: collecting lubricant oil in the compressor, which includes the discharge tube connected with the bypass tube; applying, to the collected lubricant oil, a discharge pressure of another compressor, which is connected in parallel to said one compressor in the same outdoor unit, via the bypass tube opened by the bypass opening/closing valve, and the suction tube preventing a reverse flow therethrough by the check valve, thereby pressurizing the collected lubricant oil; and feeding the pressurized lubricant oil to one compressor of another outdoor unit via the oil equalizing tube opened by the oil equalizing tube opening/closing valve and the connecting tube opened by the connecting tube opening/closing valve.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
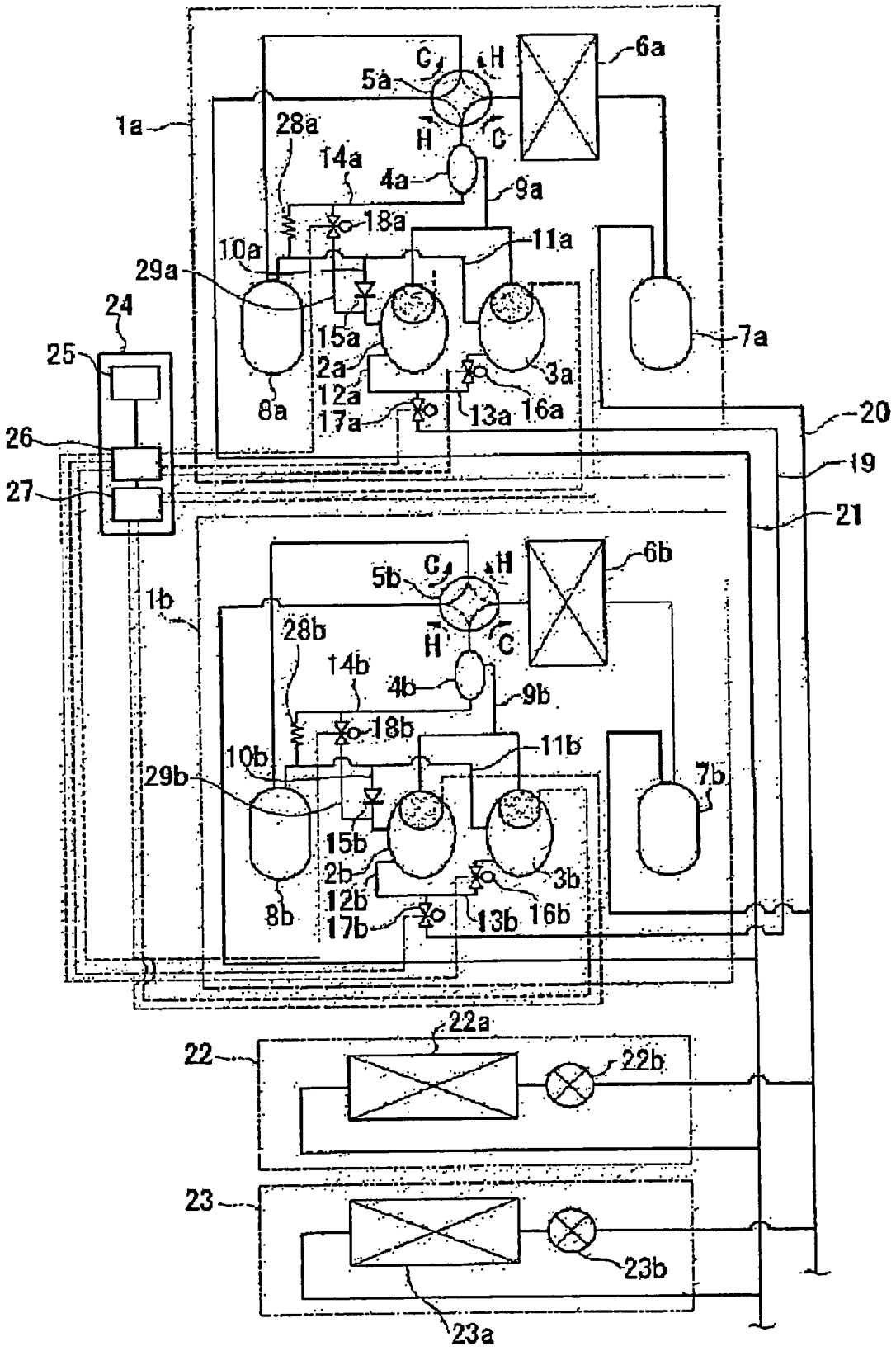
FIG. 1 is a circuit diagram illustrating the entire configuration of an air conditioner according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

First, an air conditioner according to an embodiment of the present invention will be described with reference to FIGS. 1 to 10. The air conditioner according to this embodiment includes a refrigerant circuit formed by connecting a plurality of outdoor units 1*a* and 1*b* in parallel to an external liquid conduit 20 and an external gas conduit 21, and by connecting a plurality of indoor units 22 and 23 in parallel to the external liquid conduit 20 and external gas conduit 21. The number of the outdoor units 1*a* and 1*b* and the number of the indoor units 22 and 23 may be appropriately selected in accordance with the load to be air-conditioned.

The indoor unit 22 includes a heat exchanger 22*a* and an expansion valve 22*b*. The indoor unit 23 includes a heat exchanger 23*a* and an expansion valve 23*b*. As described above, the indoor units 22 and 23 are connected to the external liquid conduit 20 and external gas conduit 21.

Since the outdoor units 1*a* and 1*b* have the same configuration, the following description will be given mainly in conjunction with the outdoor unit 1*a*. Also, each constituent part of the outdoor unit 1*b* is designated by the same reference numeral as the corresponding constituent part of the outdoor unit 1*a*, but suffixed with a reference character "b".

In the illustrated case, the outdoor unit 1*a* includes two compressors, that is, a first compressor 2*a* and a second compressor 3*a*. The first and second compressors 2*a* and 3*a* are connected, at outlets thereof, in parallel to a discharge tube 9*a*, which is, in turn, connected to a liquid separator 4*a*. The liquid separator 4*a* is connected, at an outlet thereof, to the external liquid conduit 20 via a four-way valve 5*a*, heat exchanger 6*a*, and a liquid collector 7*a*, in this order. Each of the compressors 2*a* and 3*a* is a low-pressure shell type compressor, in which the internal pressure of a compressor shell thereof during operation of the compressor is lower than the internal pressure of the compressor shell in a stopped state of the compressor. The four-way valve 5*a* is switched between a cooling mode position where refrigerant flows in a direction indicated by a solid-line arrow C (the state of FIG. 1) during a cooling operation and a heating mode position where refrigerant flows in a direction indicated by a dotted-line arrow H during a heating operation.

A liquid separator 8*a* is connected to the external gas conduit 21 through the four-way valve of the outdoor unit 1*a*. The branched suction tubes 10*a* and 11*a* of the first and second compressors 2*a* and 3*a* are connected to an outlet of the liquid separator 8*a*. The suction tube 10*a* of the first compressor 2*a* is connected to an inlet of the first compressor 2*a*. The suction tube 11*a* of the second compressor 3*a* is connected to an inlet of the second compressor 3*a*. The inlet of each of the first and second compressors 2*a* and 3*a* communicates with an oil reservoir provided in the associated compressor.

An oil return tube 14*a* is connected to the liquid separator 4*a*. The oil return tube 14*a* is also connected to an outlet of the liquid separator 8*a* via a pressure reducer 28*a*.

A bypass tube 29*a* is connected to the oil return tube 14*a* to bypass oil from the oil return tube 14*a* to the suction tube

10*a* of the first compressor 2*a*. A third opening/closing valve 18*a* is arranged in the bypass tube 29*a*.

A check valve 15*a* is arranged in the suction tube 10*a* of the first compressor 2*a* downstream from the connection between the bypass tube 29*a* and the suction tube 10*a* of the first compressor 2*a*.

Thus, in the outdoor unit 1*a*, the check valve 15*a*, bypass tube 29*a* and third opening/closing valve 18*a* are installed only at the side of the first compressor 2*a*. These elements are not installed at the side of the second compressor 3*a*. Even in the case in which an increased number of compressors are used, the check valve 15*a*, bypass tube 29*a* and third opening/closing valve 18*a* are installed only at the side of the first compressor 2*a*. This arrangement is applied to the outdoor unit 1*b* in the same manner as the indoor unit 1*a*. That is, a check valve 15*b*, bypass tube 29*b* and third opening/closing valve 18*b* are installed only at the side of the first compressor 2*b* of the outdoor unit 1*b*. These elements are not installed in the other compressor of the outdoor unit 1*b*, that is, the second compressor 3*b*.

The first and second compressors 2*a* and 3*a* are connected by an oil equalizing tube to feed surplus oil between the first and second compressors 2*a* and 3*a*. The oil equalizing tubes of the outdoor units 1*a* and 1*b* are connected by an external oil equalizing tube (connecting tube) 19. In detail, the first-compressor oil equalizing tube 12*a* connected to the first compressor 2*a* is connected with the second-compressor oil equalizing tube 13*a* connected to the second compressor 3*a* in the outdoor unit 1*a*. The first-compressor oil equalizing tube 12*b* connected to the first compressor 2*b* is connected with the second-compressor oil equalizing tube 13*b* connected to the second compressor 3*b* in the outdoor unit 1*b*. The external oil equalizing tube 19 is connected, at opposite ends thereof, to the connection between the first-compressor oil equalizing tube 12*a* and the second-compressor oil equalizing tube 13*a* in the outdoor unit 1*a* and the connection between the first-compressor oil equalizing tube 12*b* and the second-compressor oil equalizing tube 13*b* in the outdoor unit 1*b*.

A first opening/closing valve 16*a* is arranged in the second-compressor oil equalizing tube 13*a*. A second opening/closing valve 17*a* is installed in the outdoor unit 1*a* near the connection between the second-compressor oil equalizing tube 13*a* and the external oil equalizing tube 19. In the outdoor unit 1*b*, a second opening/closing valve 17*b* is installed near the connection between a second-compressor oil equalizing tube 13*b* corresponding to the second compressor oil equalizing tube 13*a* and the external oil equalizing tube 19.

Figure 2:
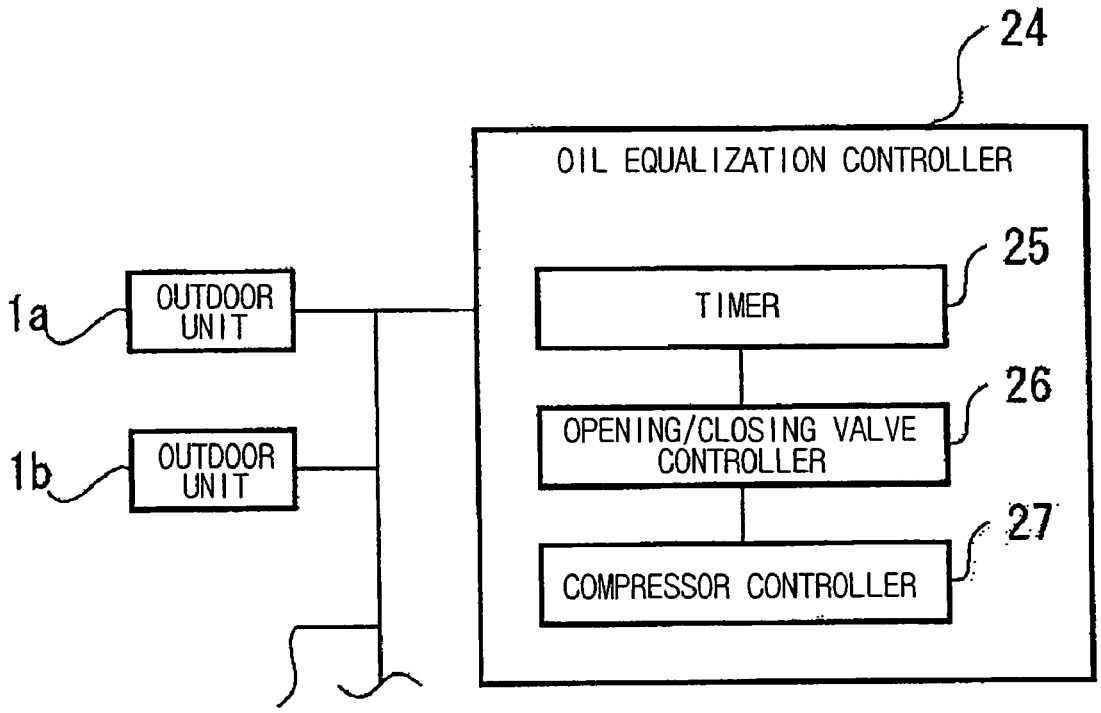
FIG. 2 is a block diagram illustrating an oil equalization controller included in the air conditioner of FIG. 1.

As shown in FIG. 2, oil equalization controller 24 includes a timer 25, an opening/closing controller 26 to control opening/closing of the first opening/closing valves (oil equalizing tube opening/closing valves) 16*a* and 16*b*, second opening/closing valves (connecting tube opening/closing valves) 17*a* and 17*b*, third opening/closing valves (bypass opening/closing valves) 18*a* and 18*b*, and a compressor controller 27 to control operations of the first compressors 2*a* and 2*b* and operations of the second compressors 3*a* and 3*b*.

Hereinafter, a method for performing an oil equalizing operation in accordance with a control operation periodically carried out by the oil equalization controller 24 will be described with reference to the time chart of FIG. 4 and FIGS. 5 to 10. In accordance with this control operation, opening/closing of the first opening/closing valves 16*a* and 16*b*, second opening/closing valves 17*a* and 17*b*, and third opening/closing valves 18*a* and 18*b* are periodically controlled, and operations of the first compressors 2*a* and 2*b* and operations of the second compressors 3*a* and 3*b* are controlled, so that oil equalization is achieved in the first compressors 2*a* and 2*b* and second compressors 3*a* and 3*b*.

Figure 3:
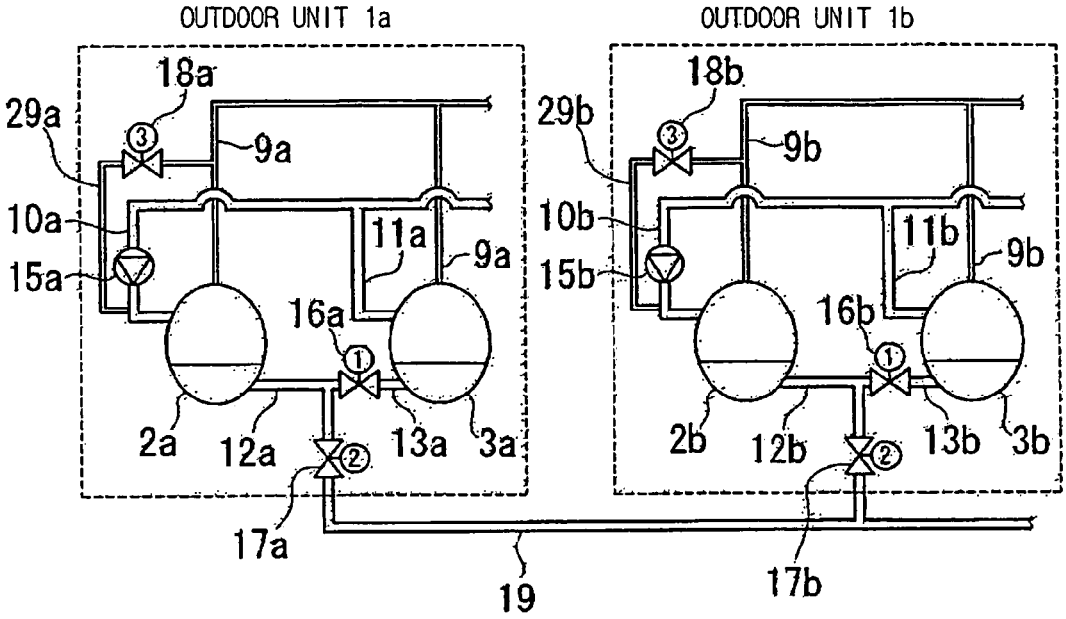
FIG. 3 is a schematic view illustrating a part of FIG. 1.

The following description will be given with reference to FIG. 3, which is a simplified version of FIG. 1, for easy understanding of the periodic control operation. In FIG. 3, constituent elements respectively corresponding to those of FIG. 1 are designated by the same reference numerals. Although the bypass tubes 29*a* and 29*b* are branched from the oil return tubes 14*a* and 14*b*, respectively, in the case of FIG. 3, they are branched from the discharge tubes 9*a* and 9*b* of the first compressors 2*a* and 2*b*, respectively, in the case of FIG. 3. In FIG. 3, the oil separators 4*a* and 4*b* are omitted.

Figure 4:
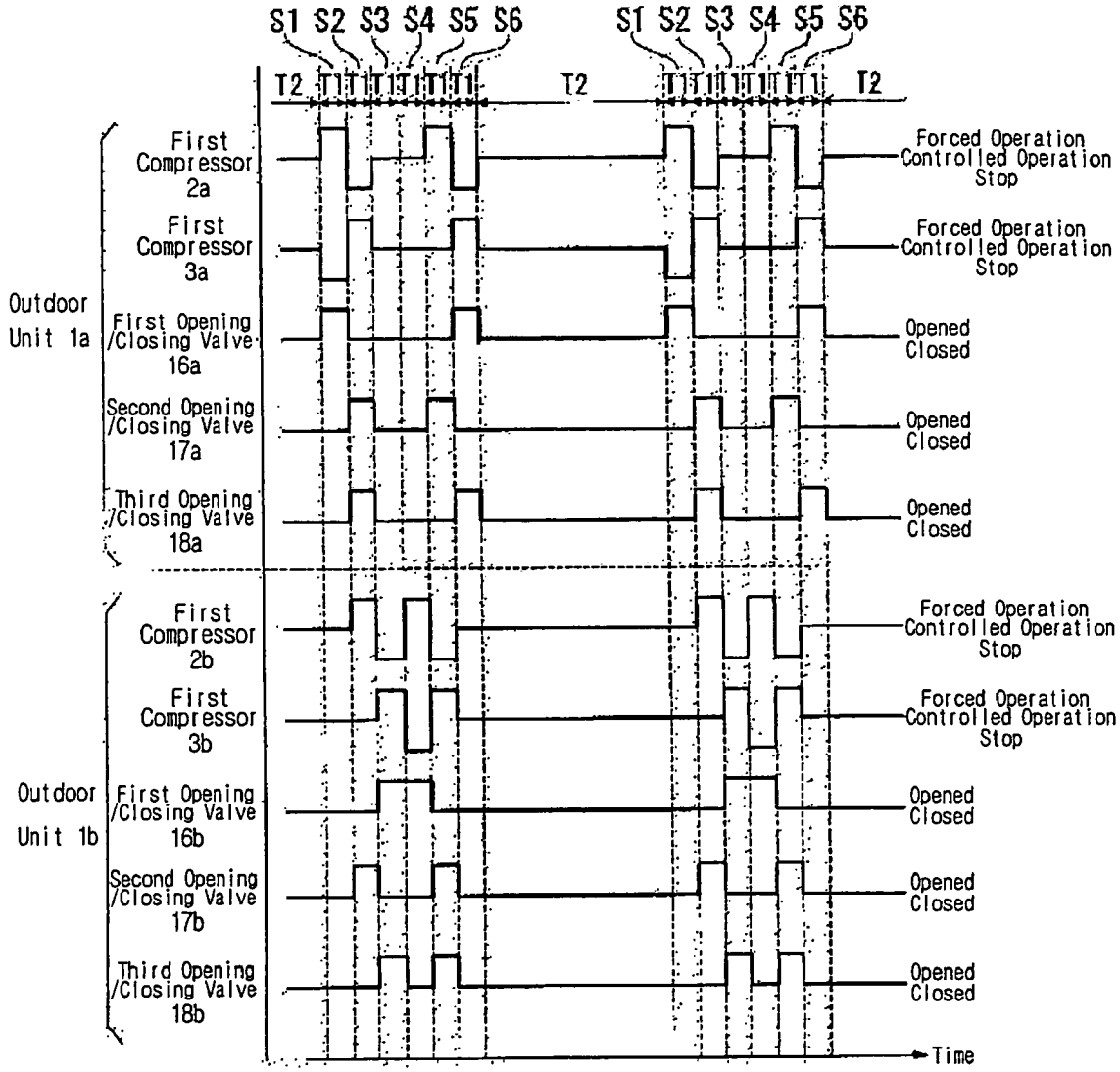
FIG. 4 is a time chart according to a method for performing an oil equalizing operation in accordance with a first embodiment of the present invention.

First, a control operation is carried out for a time T, as shown in the time chart of FIG. 4. Under this control operation, the first compressors 2*a* and 2*b* and second compressors 3*a* and 3*b* perform normal operations thereof, respectively. That is, the expansion valves 22*b* and 23*b* are adjusted in accordance with a load to be air-conditioned. Under this condition, the first compressors 2*a* and 2*b* and second compressors 3*a* and 3*b* are operated. Thus, an air-conditioning control operation is carried out. In this case, accordingly, the first opening/closing valves 16*a* and 16*b*, second opening/closing valves 17*a* and 17*b*, and third opening/closing valves 18*a* and 18*b* are maintained in a closed state.

Next, an oil equalizing operation is performed in six operations S1 to S6 for a time T for each of the six operations S1 to S6 by switching the operations of the first compressors 2*a* and 2*b* and the operations of the second compressors 3*a* and 3*b*, and simultaneously opening/closing the first opening/closing valves 16*a* and 16*b*, second opening valves 17*a* and 17*b*, and third opening/closing valves 18*a* and 18*b* at intervals of the time T. In detail, the operations of the first compressors 2*a* and 2*b*, the operations of the second compressors 3*a* and 3*b*, and the opening/closing of the first opening/closing valves 16*a* and 16*b*, second opening valves 17*a* and 17*b*, and third opening/closing valves 18*a* and 18*b* are controlled.

TABLE

| | | Operation 1 | Operation 2 | Operation 3 | Operation 4 | Operation 5 | Operation 6 |
|---|---|---|---|---|---|---|---|
| Outdoor Unit 1a | First Compressor 2a | Forced Operation | Stop | Controlled Operation | Controlled Operation | Forced Operation | Stop |
| | Second Compressor 3a | Stop | Forced Operation | Controlled Operation | Controlled Operation | Controlled Operation | Forced Operation |
| | First Opening/Closing Valve 16a | Opened | Closed | Closed | Closed | Closed | Opened |

TABLE-continued

| | | Operation 1 | Operation 2 | Operation 3 | Operation 4 | Operation 5 | Operation 6 |
|---|---|---|---|---|---|---|---|
| | Second Opening/Closing Valve 17a | Closed | Opened | Closed | Closed | Opened | Closed |
| | Third Opening/Closing Valve 18a | Closed | Opened | Closed | Closed | Closed | Opened |
| Outdoor Unit 1b | First Compressor 2b | Controlled Operation | Forced Operation | Stop | Forced Operation | Stop | Controlled Operation |
| | Second Compressor 3b | Controlled Operation | Controlled Operation | Forced Operation | Stop | Forced Operation | Controlled Operation |
| | First Opening/Closing Valve 16b | Closed | Closed | Opened | Opened | Closed | Closed |
| | Second Opening/Closing Valve 17b | Closed | Opened | Closed | Closed | Opened | Closed |
| | Third Opening/Closing Valve 18b | Closed | Closed | Opened | Closed | Opened | Closed |

In the oil equalizing operation, lubricant oil is collected in the first compressors 2*a* and 2*b*, which include respective check valves 15*a* and 15*b*, and respective third opening/closing valves 18*a* and 18*b*, and is then supplied from the first compressors 2*a* and 2*b* into other outdoor units. Upon supplying the lubricant oil, the first compressors 2*a* and 2*b*, in which the lubricant oil has been collected, are stopped. Under this condition, other compressors are forcibly operated to supply high-pressure gas into the first compressors 2*a* and 2*b* through the bypass tubes 29*a* and 29*b*, and thus, to sufficiently increase the internal pressure of the oil reservoirs of the first compressors 2*a* and 2*b*.

During the oil equalizing operation, each compressor selectively operates, in addition to the above-described controlled operation mode, in particular operation modes such as a forced operation mode and a stop mode. Here, "forced operation" means to forcibly operate the compressors by desired power without using a normal compressor control method. Also, as is the definition of the word "stop", "stop" used herein means to stop the operations of the compressors.

Figure 5:
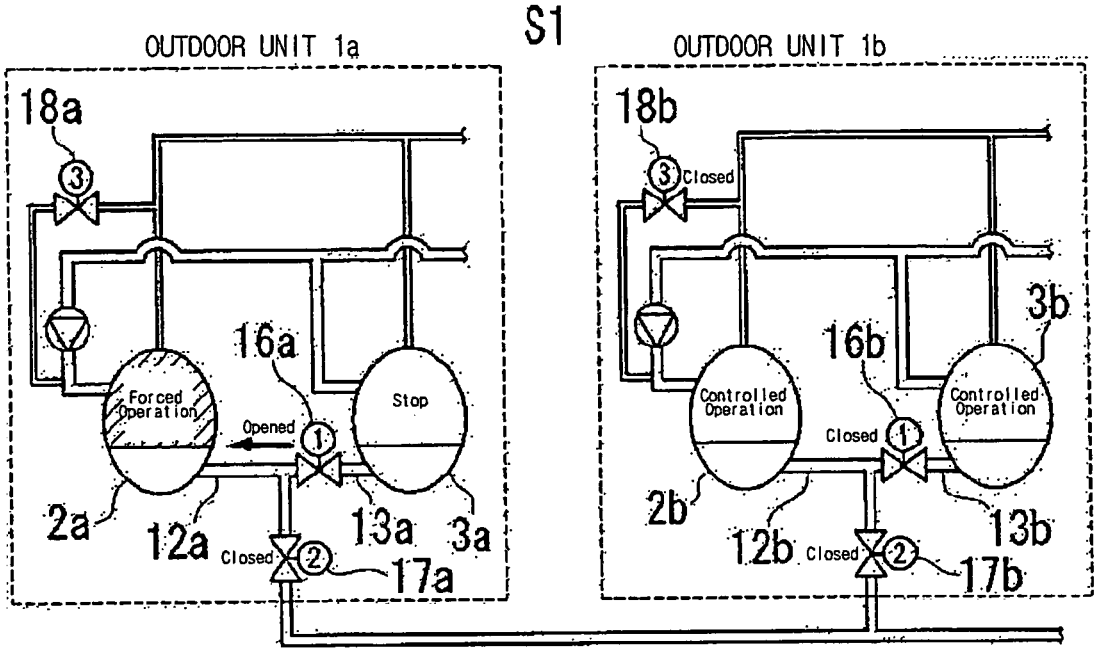
FIG. 5 is a schematic view illustrating an oil equalizing operation.

At operation S1 shown in FIG. 5, the first compressor 2*a* of the outdoor unit 1*a* is forcibly operated, whereas the second compressor 3*a* of the outdoor unit 1*a* is in a stopped state. Accordingly, the internal pressure of the first compressor 2*a* is lowered below the internal pressure of the shell of the stopped second compressor 3*a*, so that lubricant oil is fed from the second compressor 3*a* into the first compressor 2*a* via the second-compressor oil equalizing tube 13*a* and the first-compressor oil equalizing tube 12*a* (as indicated by a solid-line arrow), and is collected in the oil reservoir of the first compressor 2*a*. In this case, the first and second compressors 2*b* and 3*b* of the outdoor unit 1*b* are operated in a controlled operation mode. However, there is no flow of lubricant oil between the first and second compressors 2*b* and 3*b* because the first opening/closing valve 16*b* is in a closed state. Also, there is no flow of lubricant oil between the outdoor units 1*a* and 1*b* because the second opening/closing valves 17*a* and 17*b* are in a closed state.

Figure 6:
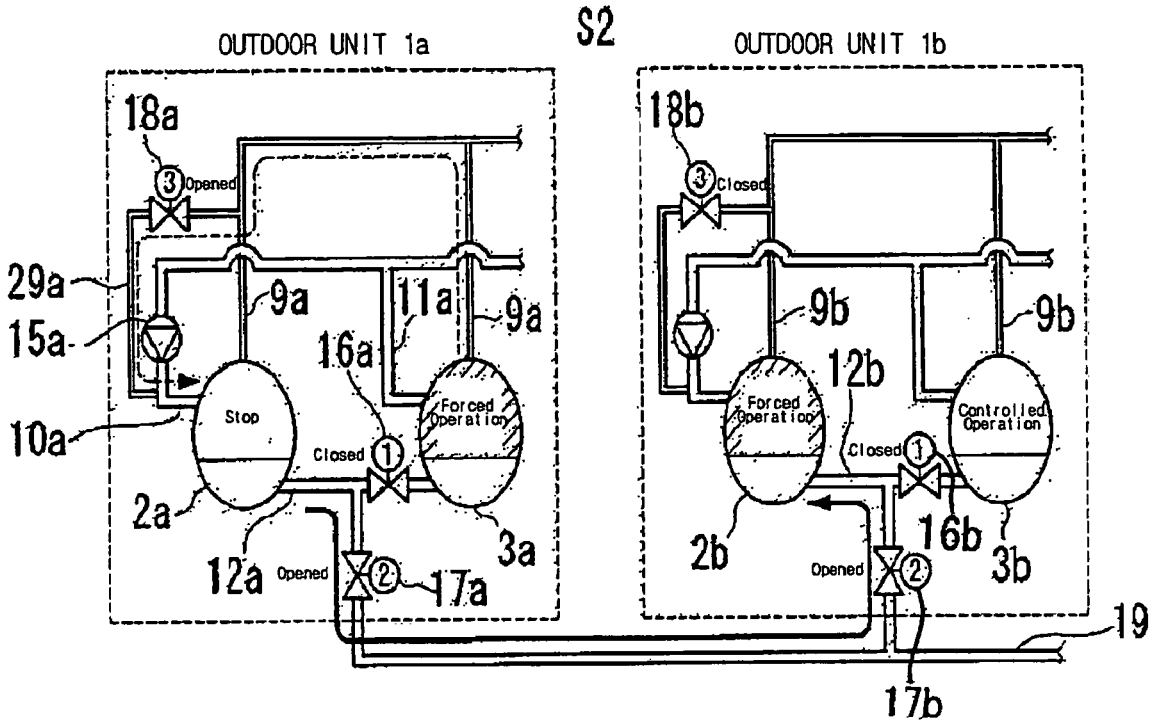
FIG. 6 is a schematic view illustrating an oil equalizing operation.

At operation S2 shown in FIG. 6, the first compressor 2*a* of the outdoor unit 1*a* is in a stopped state, whereas the second compressor 3*a* of the outdoor unit 1*a* is forcibly operated. Accordingly, the gas pressure of the second compressor 3*a* is applied to the first compressor 2*a* via the second-compressor suction tube 11*a*, which prevents a reverse flow therethrough by the discharge tube 9*a*, bypass tube 29*a*, and check valve 15*a*. As a result, the oil reservoir of the first compressor 2*a* is pressurized, so that lubricant oil is collected in the first compressor 2*b* of the outdoor unit 1*b* via the first-compressor oil equalizing tube 12*a*, the external oil equalizing tube 19, and the first-compressor oil equalizing tube 12*b* of the outdoor unit 1*b* (as indicated by a solid-line arrow). In this case, the second compressor 3*b* is operated in a controlled operation mode. However, there is no adverse affect on the flow of lubricant oil by the controlled operation of the second compressor 3*b* because the first opening/closing valve 16*b* is in a closed state. Also, there is no adverse affect on the flow of lubricant oil by the forced operation of the second compressor 3*a*.

Figure 7:
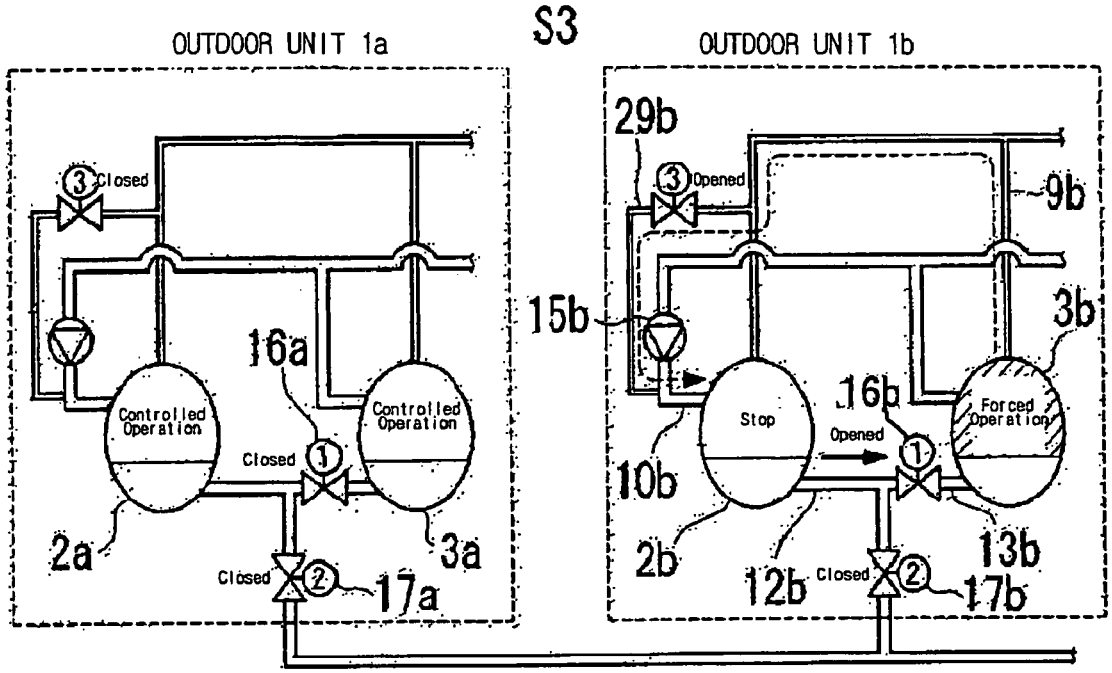
FIG. 7 is a schematic view illustrating an oil equalizing operation.

At operation S3 shown in FIG. 7, the second compressor 3*b* of the outdoor unit 1*b* is forcibly operated, whereas the first compressor 2*b* of the outdoor unit 1*b* is in a stopped state. Accordingly, the internal pressure of the second compressor 3*b* is lowered below the internal pressure of the shell of the stopped first compressor 2*b*, so that lubricant oil is fed from the first compressor 2*b* into the second compressor 3*b* via the first-compressor oil equalizing tube 12*b* and second-compressor oil equalizing tube 13*b* (as indicated by a solid-line arrow), and is collected in the oil reservoir of the second compressor 3*b*. In this case, the first and second compressors 2*a* and 3*a* of the outdoor unit 1*a* are operated in a controlled operation mode. Also, the first opening/closing valve 16*b* is in a closed state. Accordingly, there is no flow of lubricant oil between the first and second compressors 2*a* and 3*a*. Also, there is no flow of lubricant oil between the outdoor units 1*a* and 1*b* because the second opening/closing valves 17*a* and 17*b* are in a closed state. Since the third opening/closing valve 18*b* is in a closed state in this case, the gas pressure of the second compressor 3*b* is applied to the oil reservoir of the first compressor 2*b* via the discharge tube 9*b*, bypass tube 29*b*, and first-compressor suction tube 10*b*. As a result, lubricant oil can be efficiently fed from the first compressor 2*b* into the second compressor 3*b*.

Figure 8:
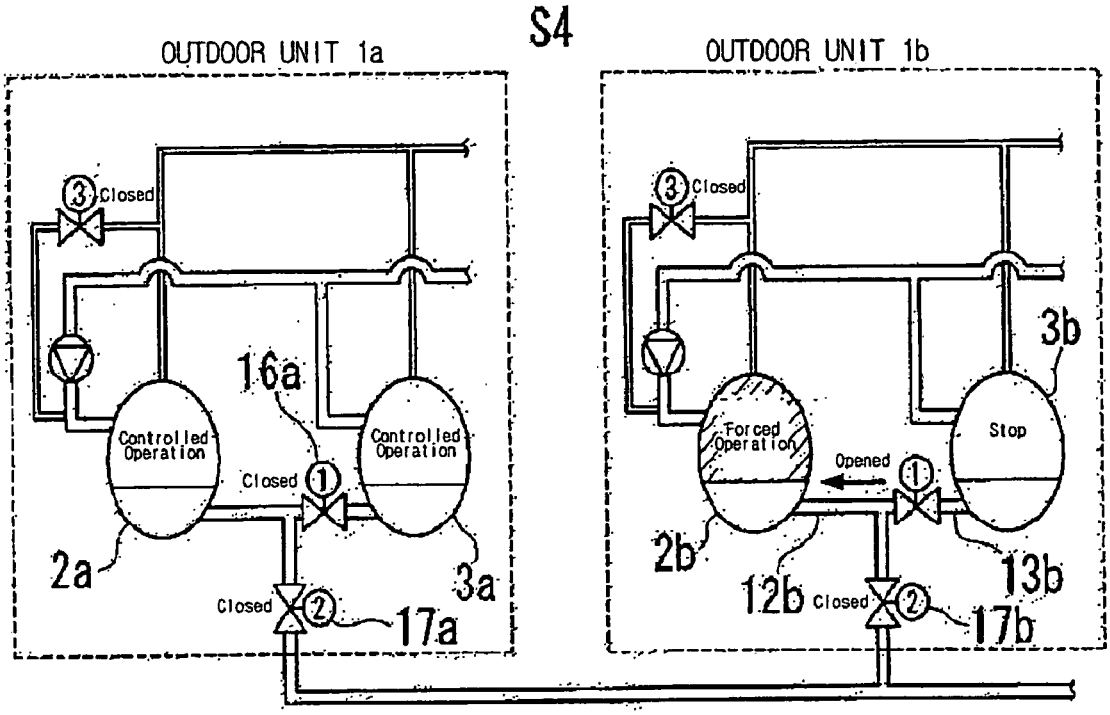
FIG. 8 is a schematic view illustrating an oil equalizing operation.

At operation S4 shown in FIG. 8, the first compressor 2*b* of the outdoor unit 1*b* is forcibly operated, whereas the second compressor 3*b* of the outdoor unit 1*b* is in a stopped state. Accordingly, the internal pressure of the first compressor 2*b* is lowered below the internal pressure of the shell of the stopped second compressor 3*b*, so that lubricant oil is fed from the second compressor 3*b* into the first compressor 2*b* via the second-compressor oil equalizing tube 13*b* and first-compressor oil equalizing tube 12*b* (as indicated by a solid-line arrow), and is collected in the oil reservoir of the first compressor 2*b*. In this case, the first and second compressors 2*a* and 3*a* of the outdoor unit 1*a* are operated in a controlled operation mode. Also, the first opening/closing valve 16*a* is in a closed state. Accordingly, there is no flow of lubricant oil between the first and second compressors 2*a* and 3*a*. Also, there is no flow of lubricant oil between the outdoor units 1*a* and 1*b* because the second opening/closing valves 17*a* and 17*b* are in a closed state.

Figure 9:
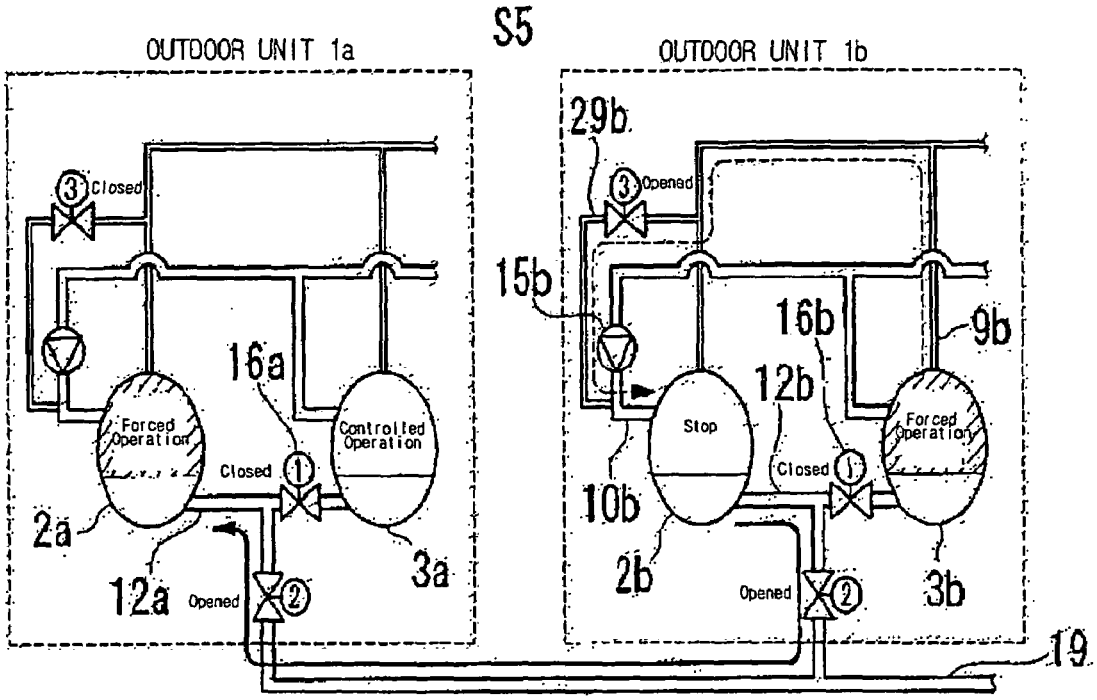
FIG. 9 is a schematic view illustrating an oil equalizing operation.

At operation S5 shown in FIG. 9, the second compressor 3*b* of the outdoor unit 1*b* is forcibly operated, whereas the first compressor 2*b* of the outdoor unit 1*b* is in a stopped state. Accordingly, the gas pressure of the second compressor 3*b* is applied to the first compressor 2*b* via the second-compressor suction tube 10*b*, which prevents a reverse flow therethrough by the discharge tube 9*b*, bypass tube 29*b*, and check valve 15*b*. As a result, the oil reservoir of the first compressor 2*b* is pressurized, so that lubricant oil is collected in the first compressor 2*a* of the outdoor unit 1*a* via the first-compressor oil equalizing tube 12*b*, the external oil equalizing tube 19, and the first-compressor oil equalizing tube 12*a* of the outdoor unit 1*a* (as indicated by a solid-line arrow). In this case, the second compressor 3*a* is operated in a controlled operation mode. However, there is no adverse affect on the flow of lubricant oil by the controlled operation of the second compressor 3*a* because the first opening/closing valve 16*a* is in a closed state. Also, there is no adverse affect on the flow of lubricant oil by the forced operation of the second compressor 3*b*.

Figure 10:
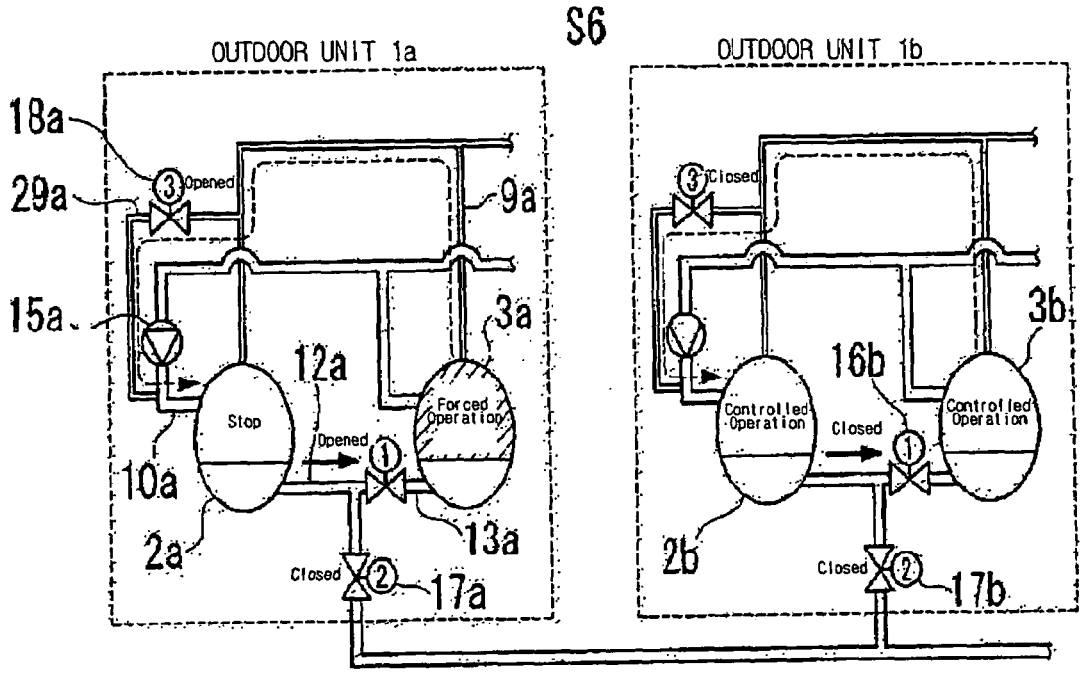
FIG. 10 is a schematic view illustrating an oil equalizing operation.

At operation S6 shown in FIG. 10, the second compressor 3*a* of the outdoor unit 1*a* is forcibly operated, whereas the first compressor 2*a* of the outdoor unit 1*a* is in a stopped state. Accordingly, the internal pressure of the second compressor 3*a* is lowered below the internal pressure of the shell of the stopped first compressor 2*a*, so that lubricant oil is fed from the first compressor 2*a* into the second compressor 3*a* via the first-compressor oil equalizing tube 12*a* and second-compressor oil equalizing tube 13*a* (as indicated by a solid-line arrow), and is collected in the oil reservoir of the second compressor 3*a*. In this case, the first and second compressors 2*b* and 3*b* of the outdoor unit 1*b* are operated in a controlled operation mode. Also, the first opening/closing valve 16*b* is in a closed state. Accordingly, there is no flow of lubricant oil between the first and second compressors 2*b* and 3*b*. Also, there is no flow of lubricant oil between the outdoor units 1*a* and 1*b* because the second opening/closing valves 17*a* and 17*b* are in a closed state. Since the third opening/closing valve 18*a* is in a closed state in this case, the gas pressure of the second compressor 3*a* is applied to the oil reservoir of the first compressor 2*a* via the discharge tube 9*a*, bypass tube 29*a*, and first-compressor suction tube 10*a*. As a result, lubricant oil can be efficiently fed from the first compressor 2*a* into the second compressor 3*a*.

Thus, at operation S1 shown in FIG. 5 and operation S4 shown in FIG. 8, lubricant oil is collected in the first compressors 2*a* and 2*b*, which are provided with respective check valves 15*a* and 15*b* and respective bypass tubes 29*a* and 29*b*, in accordance with the characteristics of a low-pressure shell type compressor in which a reduction in pressure occurs during operation of the compressor. Accordingly, it is possible to reliably and inexpensively perform a desired oil equalizing operation, using a simple operation to stop a desired compressor.

At operation S2 shown in FIG. 6 and operation S5 shown in FIG. 9, it is possible to achieve an oil equalizing operation in which the lubricant oil from the stopped compressor of one outdoor unit is rapidly supplied into the other outdoor unit within a reduced period of time by efficiently using pressure generated in accordance with a forced operation of the other compressor of the one-compressor-stopped outdoor unit (that is, the second compressor 3*a* or 3*b*) during a normal controlled operation. Thus, it is possible to reduce the oil equalizing operation time, and to efficiently achieve oil equalization.

Also, at operation S3 shown in FIG. 7, oil equalization is performed between the first compressor 2*b* and the second compressor 3*b* in the outdoor unit 1*b* by feeding, into the second compressor 3*b*, the lubricant oil in the first compressor 2*b* supplied from the outdoor unit 1*a* at operation S2 shown in FIG. 6. At operation S6 shown in FIG. 10, oil equalization is performed between the first compressor 2*a* and the second compressor 3*a* in the outdoor unit 1*a* by feeding, into the second compressor 3*a*, the lubricant oil in the first compressor 2*a* supplied from the outdoor unit 1*b* at operation S5 shown in FIG. 9.

In accordance with the sequential feeding of lubricant oil in the above-described manner, the amounts of lubricant oil in all compressors 2*a*, 3*a*, 2*b*, and 3*b* are equalized within a reduced period of time. Thus, a reliable and efficient oil system is implemented. Accordingly, the restriction on the length and diameter of pipes is reduced. Also, there is no problem caused by different levels of the constituent elements of the air conditioner. Therefore, it is possible to achieve a widened freedom of the design including the installation of outdoor units. Moreover, it is basically necessary to install a check valve. (check valve 15*a* or 15*b*) and a bypass tube (bypass tube 29*a* or 29*b*) only in one compressor (first compressor 2*a* or 2*b*) of each outdoor unit (outdoor unit 1*a* or 1*b*). Accordingly, it is unnecessary to install such elements in all compressors, as in conventional cases. Thus, a reduction in costs is achieved in accordance with a reduction in the number of constituent elements used in the air conditioner. In addition, the costs may be further reduced because an improvement in the reliability of the system is achieved in accordance with a reduction in factors causing failure.

In particular, in accordance with the method for performing an oil equalizing operation, using a periodic control operation, as described above, oil equalization can be achieved, using simple operations. Accordingly, it is possible to easily manage the oil equalizing operation. Also, the oil equalization can be conveniently achieved because it is unnecessary to use detectors during a normal controlled operation.

Figure 11:
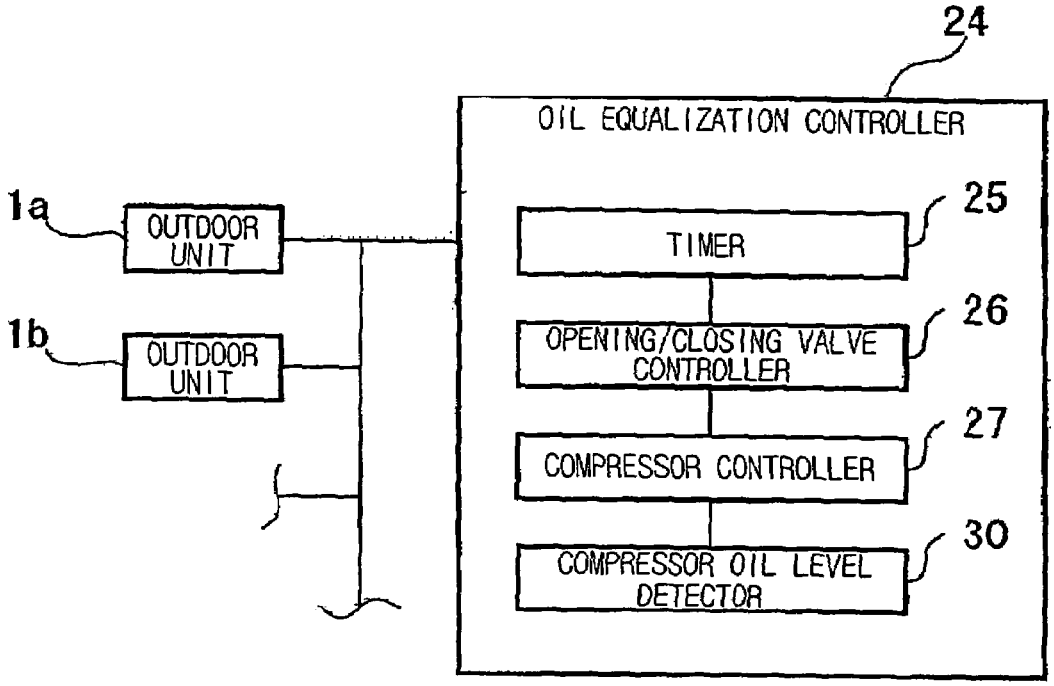
FIG. 11 is a block diagram illustrating an oil equalization controller included in an air conditioner according to a second embodiment of the present invention.

Hereinafter, a method for performing an oil equalizing operation in accordance with a liquid level detection control operation carried out by the oil equalization controller 24 will be described with reference to the block diagram of FIG. 11, flow charts of FIGS. 12 to 16, and FIGS. 17 to 20. For the liquid level detection control operation, a compressor liquid level detector 30 is used in addition to the oil equalization controller 24 used for the above-described periodic control operation, as shown in FIG. 11. In accordance with the liquid level detection control operation, based on the detection results of the compressor liquid level detector 30, opening/closing of the first opening/closing valves 16*a* and 16*b*, second opening/closing valves 17*a* and 17*b*, and third opening/closing valves 18*a* and 18*b* are controlled, and operations of the first compressors 2*a* and 2*b* and operations of the second compressors 3*a* and 3*b* are controlled, so that oil equalization is performed in the first compressors 2*a* and 2*b* and second compressors 3*a* and 3*b*. The liquid level detector may be implemented using a flow switch.

Thus, the configuration of FIG. 11 is basically the same as that of FIG. 1, except for the addition of the compressor liquid level detector 30, and thus, description thereof will be omitted. Also, FIGS. 17 to 20, which are used in association with descriptions given by the flow charts, are simplified versions, as in FIGS. 5 to 10 used for the above-mentioned periodic control operation.

Also, in the flow charts shown in FIGS. 12 to 16, for simplification of description, the term "first" used in the first compressors 2*a*, 2*b* and first opening/closing valves 16*a* and 16*b*, the term "second" used in the second compressors 3*a* and 3*b* and second opening/closing valves 17*a* and 17*b*, and the term "third" used in the third opening/closing valves 18*a* and 18*b* are omitted. In addition, the forced operation in the operation mode of the compressors is simply referred to as "operation", and the controlled operation is simply referred to as "normal control".

Figure 12:
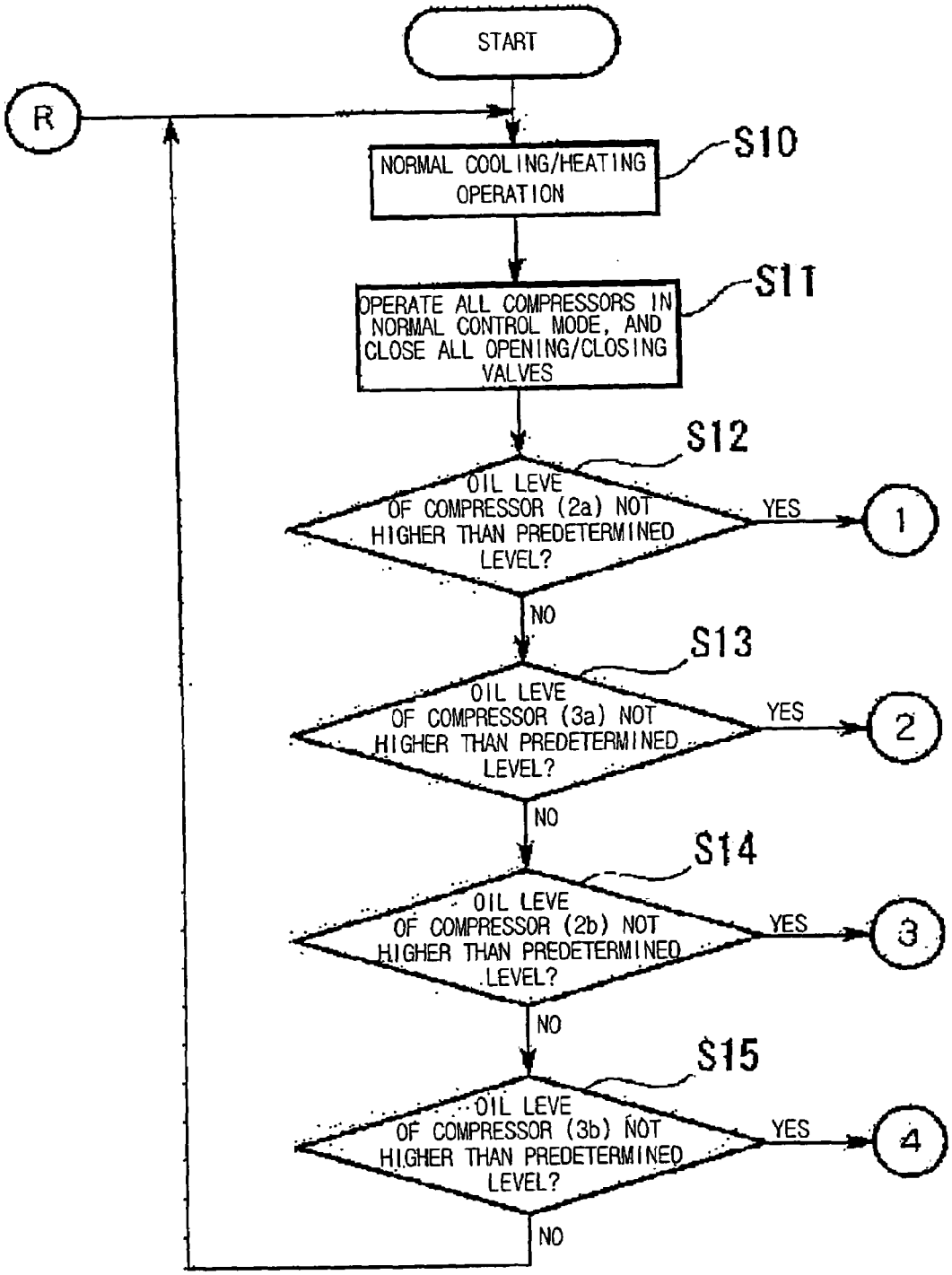
FIG. 12 is a flow chart illustrating a method for performing an oil equalizing operation in accordance with a second embodiment of the present invention.

At operation 10, a normal cooling/heating operation is performed, as shown in the flow chart of FIG. 12. In this case, accordingly, all opening/closing valves are closed so that all compressors are operated in a normal control mode at operation S11. During the operations of the compressors in the normal control mode, it is determined at operation S12 whether the oil level of the first compressor 2*a* is not higher than a predetermined level. If the determination corresponds to "YES", the procedure proceeds to operation S16 of FIG. 13. On the other hand, if the determination corresponds to "NO", the procedure proceeds to operation S13.

At operation S13, it is determined whether the oil level of the second compressor 3*a* is not higher than the predetermined level. If the determination corresponds to "YES", the procedure proceeds to operation S23 of FIG. 14. On the other hand, if the determination corresponds to "NO", the procedure proceeds to operation S14.

At operation S14, it is determined whether the oil level of the first compressor 2*b* is not higher than the predetermined level. If the determination corresponds to "YES", the procedure proceeds to operation S32 of FIG. 15. On the other hand, if the determination corresponds to "NO", the procedure proceeds to operation S15.

At operation S15, it is determined whether the oil level of the second compressor 3*b* is not higher than the predetermined level. If the determination corresponds to "YES", the procedure proceeds to operation S39 of FIG. 16. On the other hand, if the determination corresponds to "NO", the procedure proceeds to operation S10.

Figure 13:
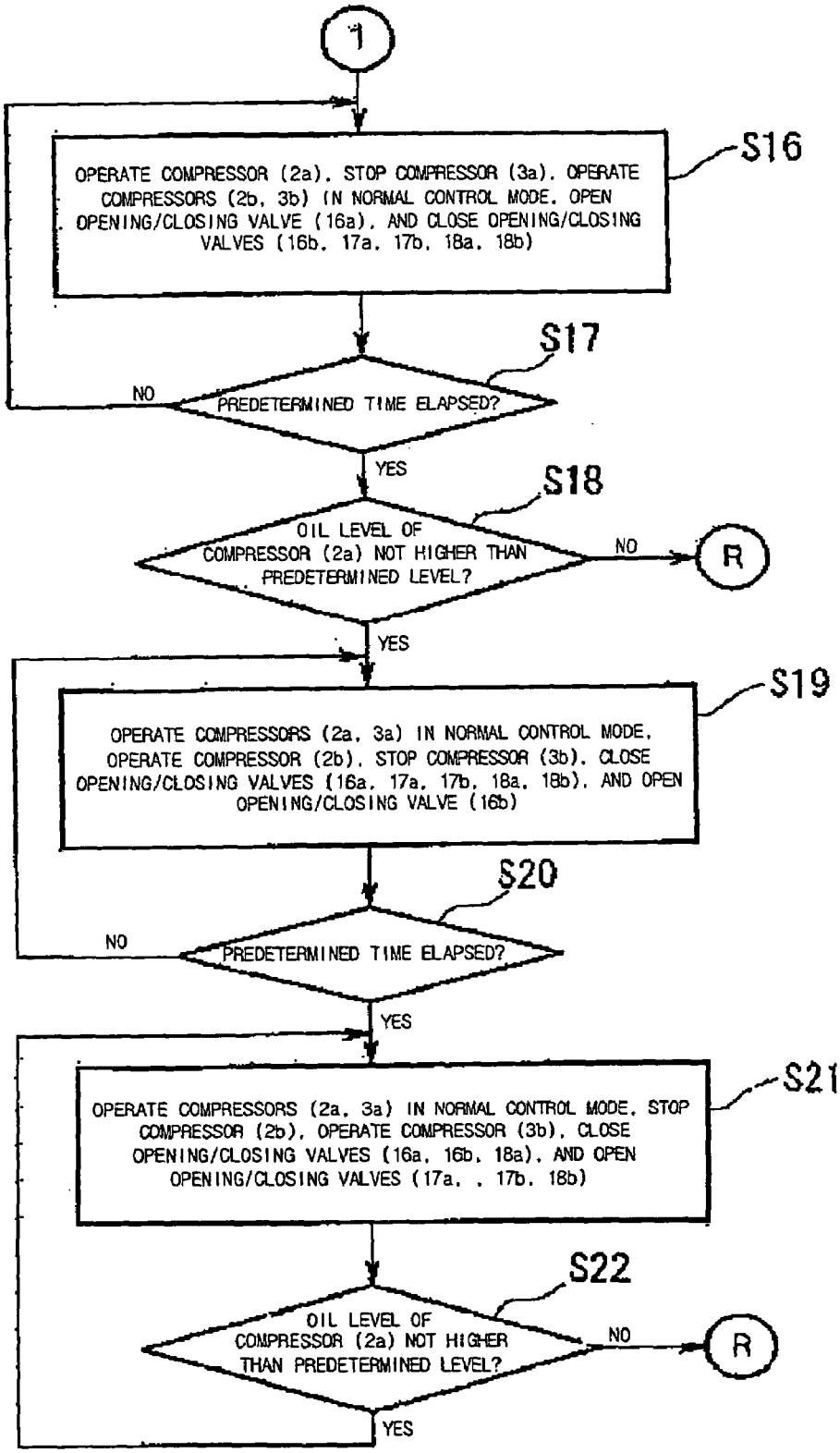
FIG. 13 is a flow chart illustrating the method for performing an oil equalizing operation in accordance with the second embodiment of the present invention.

When it is determined at operation S12 that the oil level of the first compressor 2*a* is not higher than the predetermined level, operation S16 of FIG. 13 is executed to forcibly operate the first compressor 2*a*, to stop the second compressor 3*a*, and to operate the first and second compressors 2*b* and 3*b* in the controlled operation mode. In this case, only, the first opening/closing valve 16*a* is opened, whereas the remaining opening/closing valves are maintained in a closed state. The condition established at operation S16 is maintained for a predetermined time at operation S17.

Figure 17:
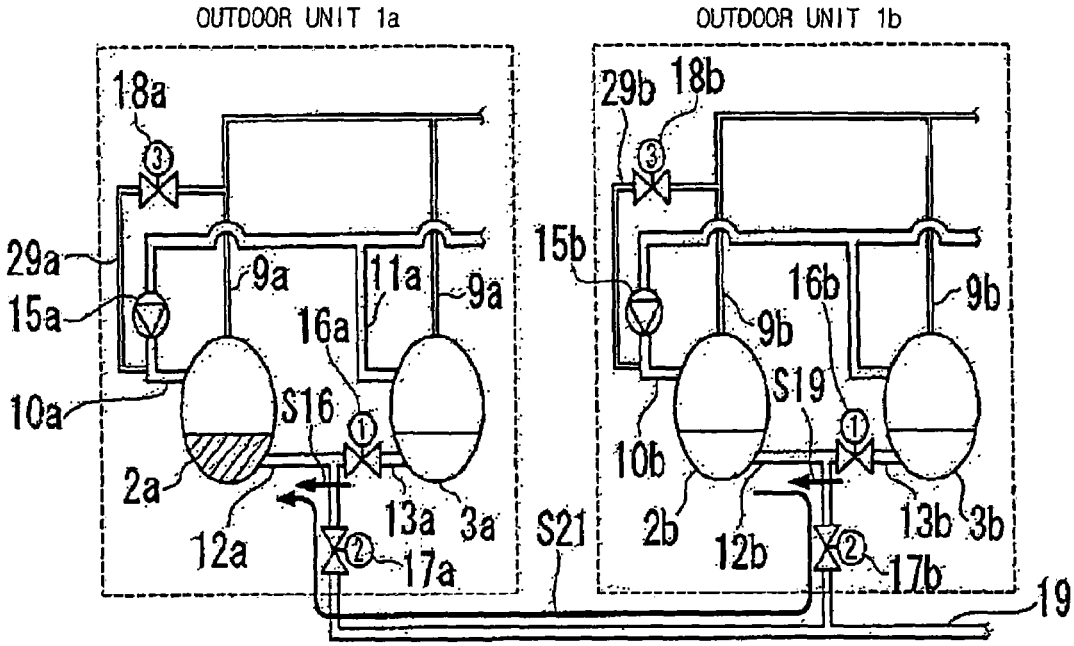
FIG. 17 is a schematic view illustrating an oil equalizing operation.

As a result, lubricant oil is moved from the second compressor 3*a* to the first compressor 2*a*, as indicated by arrow S16 in FIG. 17, thus increasing the oil level of the first compressor 2*a*.

Thereafter, it is determined at operation S18 whether the oil level of the first compressor 2*a* is not higher than the predetermined level. If the determination corresponds to "YES", the procedure proceeds to operation S19. On the other hand, if the determination corresponds to "NO", the procedure returns to operation S10 of FIG. 12.

At operation S19, a control operation is executed to operate the first and second compressors 2*a* and 3*a* in the controlled operation mode, to forcibly operate the first compressor 2*b*, and to stop the second compressor 3*b*. In this case, only the first opening/closing valve 16*b* is opened, whereas the remaining opening/closing valves are maintained in a closed state. The condition established at operation S19 is maintained for a predetermined time at operation S20.

As a result, lubricant oil is moved from the second compressor 3*b* to the first compressor 2*b*, as indicated by arrow S19 in FIG. 17, thus increasing the oil level of the first compressor 2*b*.

At operation S21, a control operation is executed to operate the first and second compressors 2*a* and 3*a* in the controlled operation mode, to stop the first compressor 2*b*, and to forcibly operate the second compressor 3*b*. In this case, the first opening/closing valves 16*a* and 16*b*, and third opening/closing valve 18*a* are opened, whereas the second opening/closing valves 17*a* and 17*b* and third opening/closing valve 18*b* are closed. It is then determined at operation S22 whether the oil level of the first compressor 2*a* is not higher than the predetermined level. If the determination corresponds to "YES", the procedure proceeds to operation S21. On the other hand, if the determination corresponds to "NO", the procedure returns to operation S10 of FIG. 12.

As a result, lubricant oil is moved from the first compressor 2*b* to the first compressor 2*a*, as indicated by arrow S21 in FIG. 17, thus increasing the oil level of the first compressor 2*a*.

Figure 14:
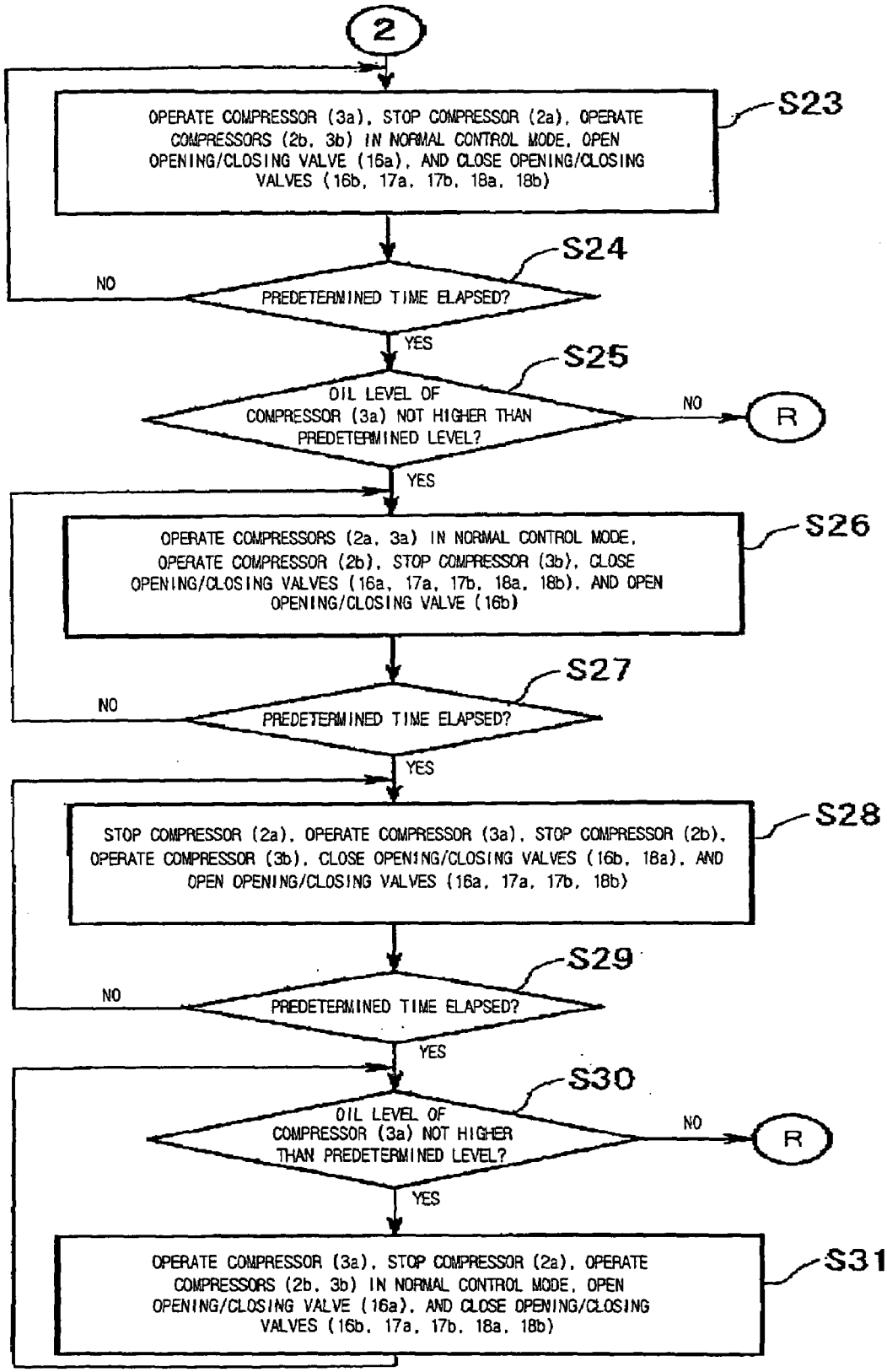
FIG. 14 is a flow chart illustrating the method for performing an oil equalizing operation in accordance with the second embodiment of the present invention.

When it is determined at operation S13 of FIG. 12 that the oil level of the second compressor 3*a* is not higher than the predetermined level, operation S23 of FIG. 14 is executed to forcibly operate the second compressor 3*a*, to stop the first compressor 2*a*, and to operate the first and second compressors 2*b* and 3*b* in the controlled operation mode. In this case, only the first opening/closing valve 16*a* is opened, whereas the remaining opening/closing valves are maintained in a closed state. The condition established at operation S23 is maintained for a predetermined time at operation S24.

Figure 18:
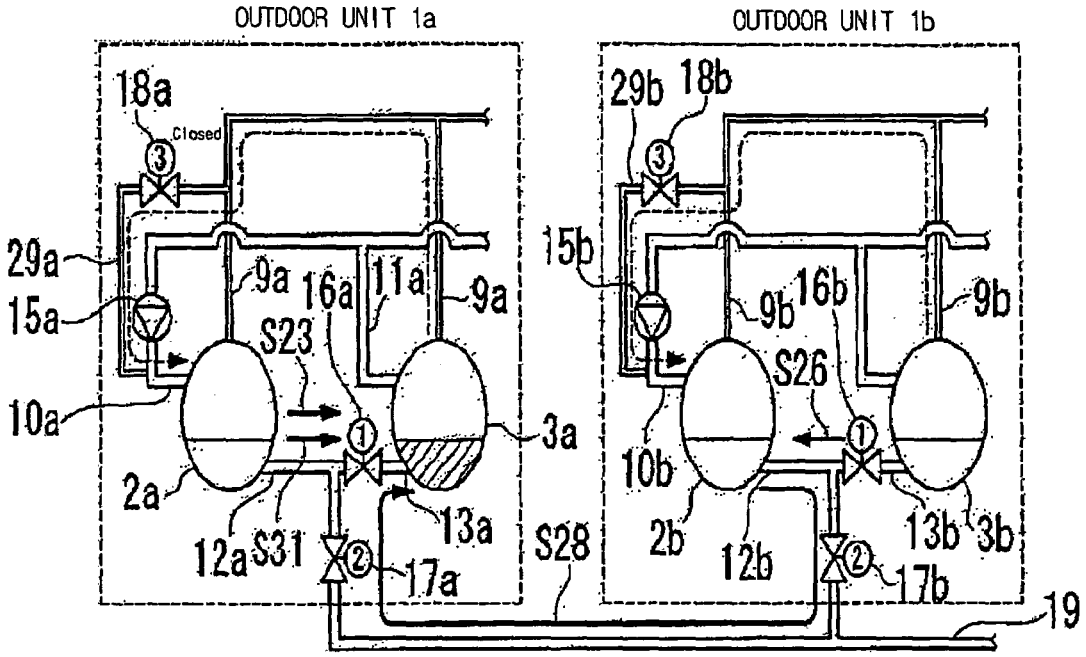
FIG. 18 is a schematic view illustrating an oil equalizing operation.

As a result, lubricant oil is moved from the first compressor 2*a* to the second compressor 3*a*, as indicated by arrow S23 in FIG. 18, thus increasing the oil level of the second compressor 3*a*.

Thereafter, it is determined at operation S25 whether the oil level of the second compressor 3*a* is not higher than the predetermined level. If the determination corresponds to "YES", the procedure proceeds to operation S26. On the other hand, if the determination corresponds to "NO", the procedure returns to operation S10 of FIG. 12.

At operation S26, a control operation is executed to operate the first and second compressors 2*a* and 3*a* in the controlled operation mode, to forcibly operate the first compressor 2*b*, and to stop the second compressor 3*b*. In this case, only the first opening/closing valve 16*b* is opened, whereas the remaining opening/closing valves are maintained in a closed state. The condition established at operation S26 is maintained for a predetermined time at operation S27.

As a result, lubricant oil is moved from the second compressor 3*b* to the first compressor 2*b*, as indicated by arrow S26 in FIG. 18, thus increasing the oil level of the first compressor 2*b*.

At operation S28, a control operation is executed to stop the first compressors 2*a* and 2*b* and to forcibly operate the second compressors 3*a* and 3*b*. In this case, the first opening/closing valve 16*b* and third opening/closing valve 18*a* are closed, whereas the remaining opening/closing valves are opened. The condition established at operation S28 is maintained for a predetermined time at operation S29.

As a result, lubricant oil is moved from the first compressor 2*b* to the second compressor 3*a*, as indicated by arrow S28 in FIG. 18, thus increasing the oil level of the second compressor 3*a*.

It is then determined at operation S30 whether the oil level of the second compressor 3*a* is not higher than the predetermined level. If the determination corresponds to "YES", the procedure proceeds to operation S31. On the other hand, if the determination corresponds to "NO", the procedure returns to operation S10 of FIG. 12.

At operation S31, a control operation is executed to stop the first compressor 2*a*, to forcibly operate the second compressor 3*a*, and to operate the first and second compressors 2*b* and 3*b* in the controlled operation mode. In this case, only the first opening/closing valve 16*b* is opened, whereas the remaining opening/closing valves are maintained in a closed state.

As a result, lubricant oil is moved from the first compressor 2*a* to the second compressor 3*a*, as indicated by arrow S31 in FIG. 18, thus increasing the oil level of the second compressor 3*a*.

Figure 15:
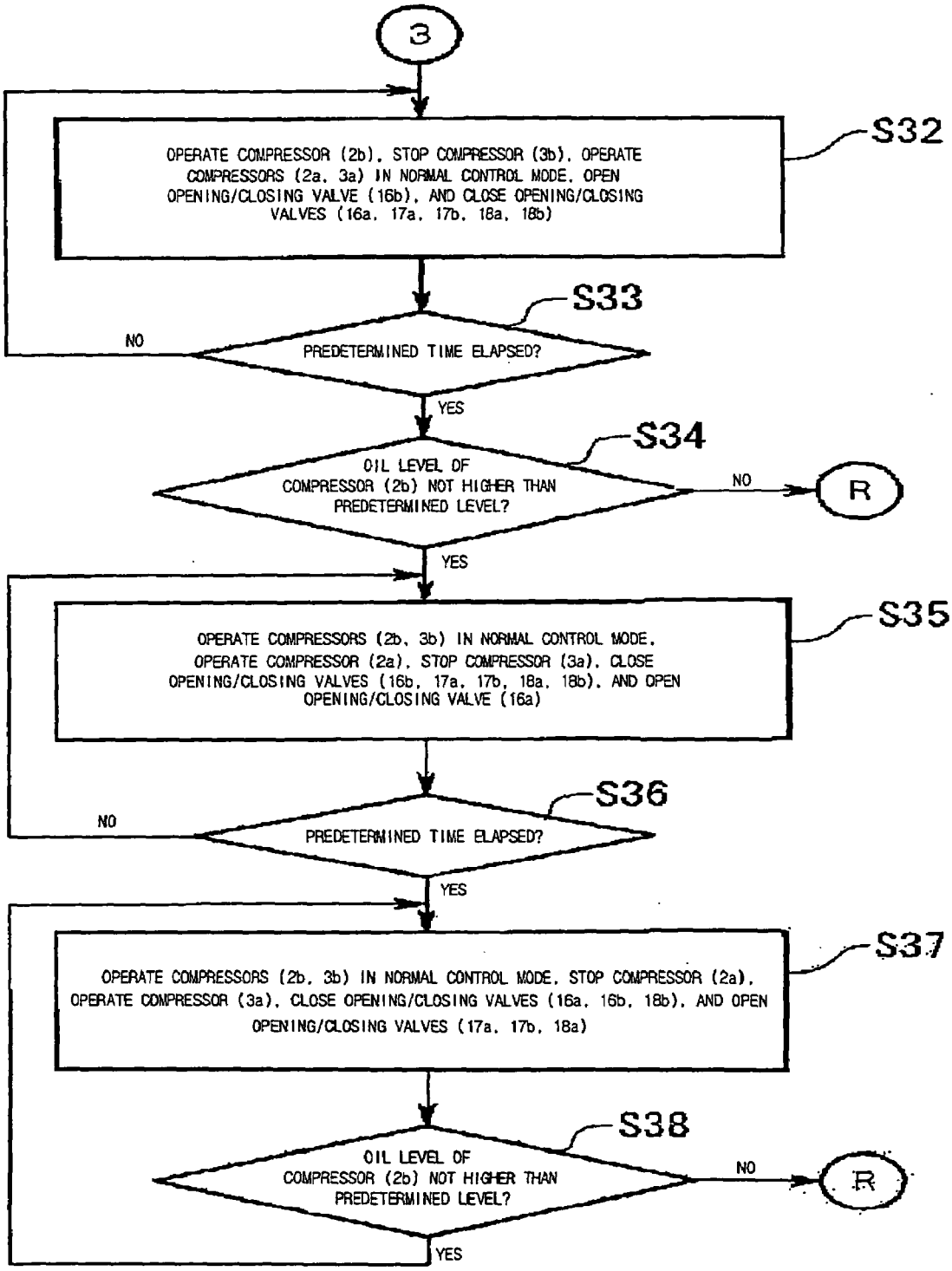
FIG. 15 is a flow chart illustrating the method for performing an oil equalizing operation in accordance with the second embodiment of the present invention.

When it is determined at operation S12 that the oil level of the first compressor 2*b* is not higher than the predetermined level, operation S32 of FIG. 15 is executed to forcibly operate the first compressor 2*b*, to stop the second compressor 3*b*, and to operate the first and second compressors 2*a* and 3*a* in the controlled operation mode. In this case, only the first opening/closing valve 16*b* is opened, whereas the remaining opening/closing valves are maintained in a closed state. The condition established at operation S32 is maintained for a predetermined time at operation S33.

Figure 19:
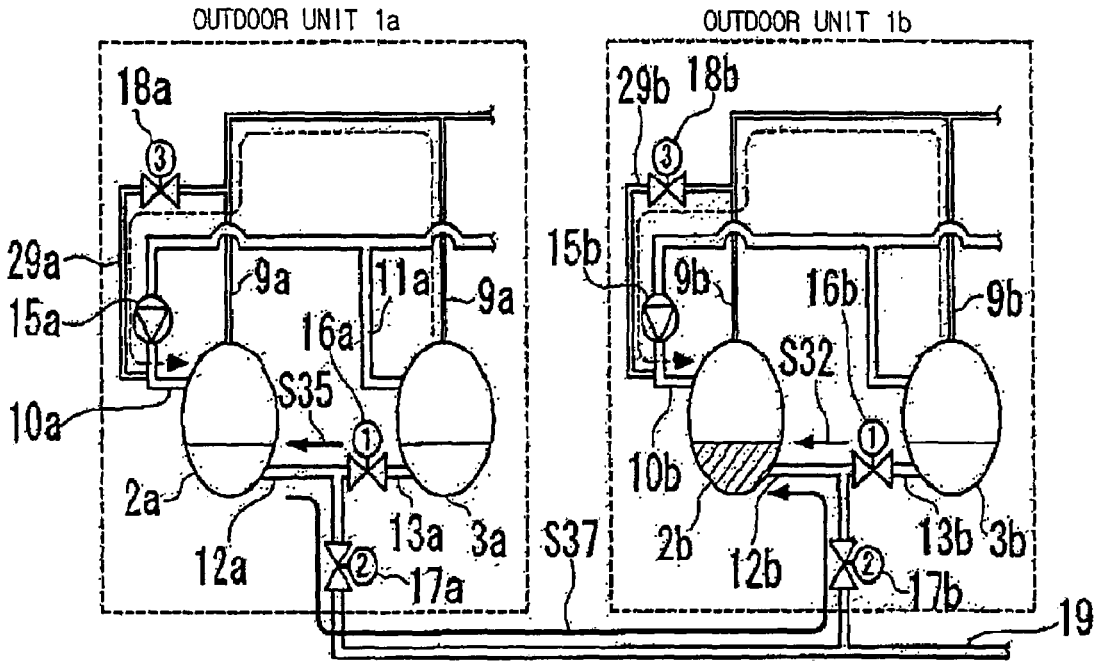
FIG. 19 is a schematic view illustrating an oil equalizing operation.

As a result, lubricant oil is moved from the second compressor 3*b* to the first compressor 2*b*, as indicated by arrow S32 in FIG. 19, thus increasing the oil level of the first compressor 2*b*.

Thereafter, it is determined at operation S34 whether the oil level of the first compressor 2*b* is not higher than the predetermined level. If the determination corresponds to "YES", the procedure proceeds to operation S35. On the other hand, if the determination corresponds to "NO", the procedure returns to operation S10 of FIG. 12.

At operation S35, a control operation is executed to operate the first and second compressors 2*b* and 3*b* in the controlled operation mode, to forcibly operate the first compressor 2*a*, and to stop the second compressor 3*a*. In this case, only the first opening/closing valve 16*a* is opened, whereas the remaining opening/closing valves are maintained in a closed state.

As a result, lubricant oil is moved from the second compressor 3*a* to the first compressor 2*a*, as indicated by arrow S35 in FIG. 19, thus increasing the oil level of the first compressor 2*a*.

At operation S37, a control operation is executed to operate the first and second compressors 2*b* and 3*b* in the controlled operation mode, to stop the first compressor 2*a*, and to forcibly operate the second compressor 3*a*. In this case, the first opening/closing valves 16*a* and 16*b* and third opening/closing valve 18*b* are closed, whereas the second opening/closing valves 17*a* and 17*b* and third opening/closing valve 18*b* are opened. Under this condition, it is determined at operation S38 whether the oil level of the first compressor 2*b* is not higher than the predetermined level. If the determination corresponds to "YES", the procedure proceeds to operation S37. On the other hand, if the determination corresponds to "NO", the procedure returns to operation S10 of FIG. 12.

In accordance with the control operation executed at operation S37, lubricant oil is moved from the first compressor 2*a* to the first compressor 2*b*, as indicated by arrow S37 in FIG. 19, thus increasing the oil level of the first compressor 2*b*.

Figure 16:
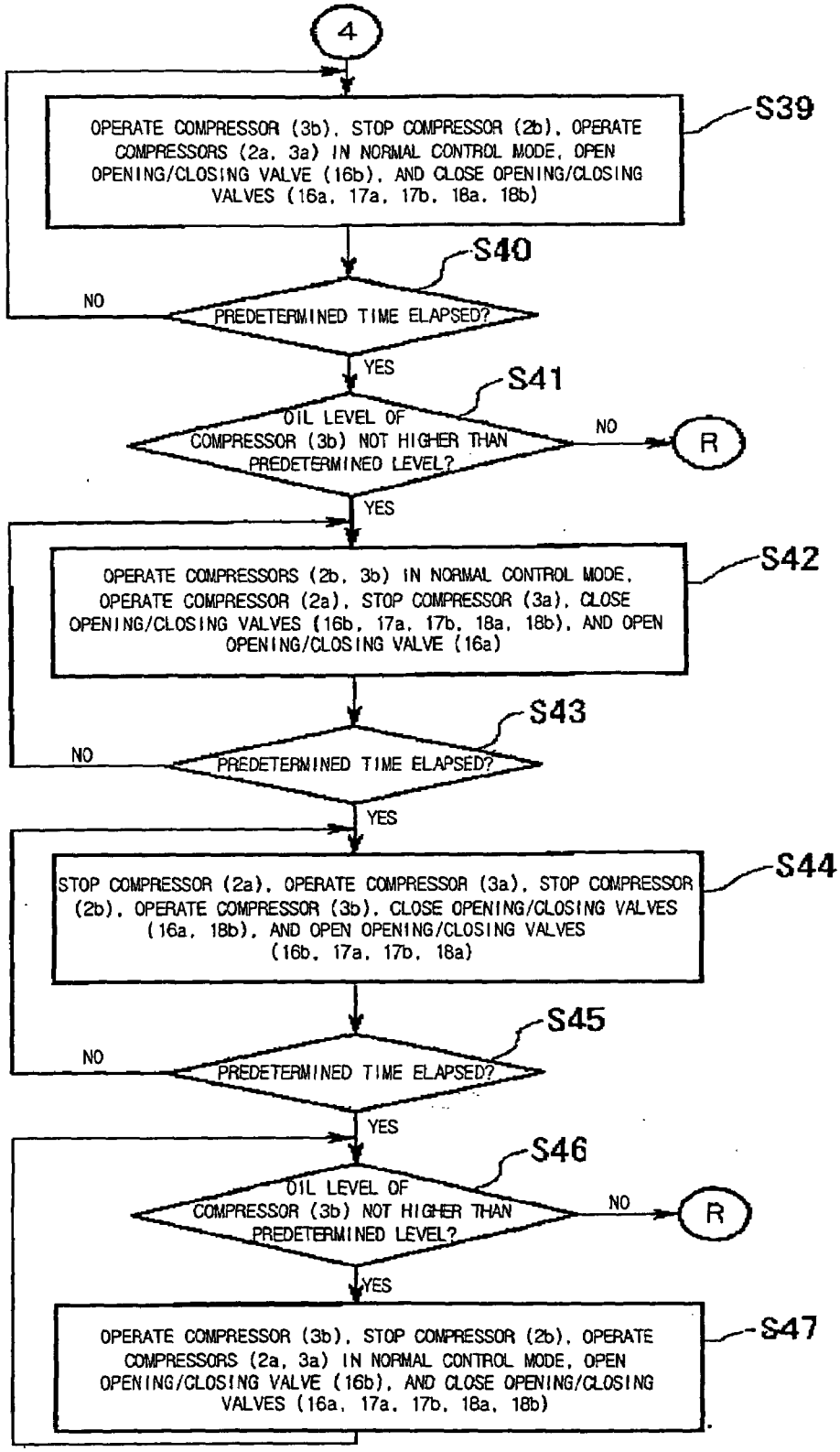
FIG. 16 is a flow chart illustrating the method for performing an oil equalizing operation in accordance with the second embodiment of the present invention.

When it is determined at operation S15 of FIG. 12 that the oil level of the second compressor 3*b* is not higher than the predetermined level, a control operation is executed at operation S39 of FIG. 16 to forcibly operate the second compressor 3*b*, to stop the first compressor 2*b*, and to operate the first and second compressors 2*a* and 3*a* in the controlled operation mode. In this case, only the first opening/closing valve 16*b* is opened, whereas the remaining opening/closing valves are maintained in a closed state. The condition established at operation S39 is maintained for a predetermined time at operation S40.

Figure 20:
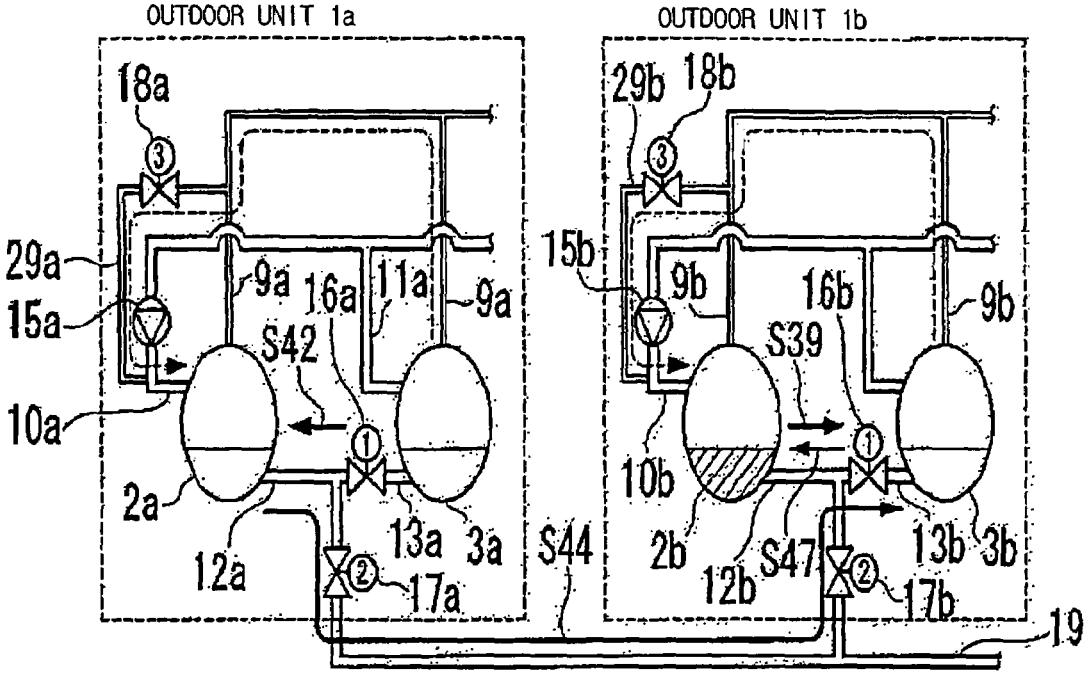
FIG. 20 is a schematic view illustrating an oil equalizing operation.
Figure 21:
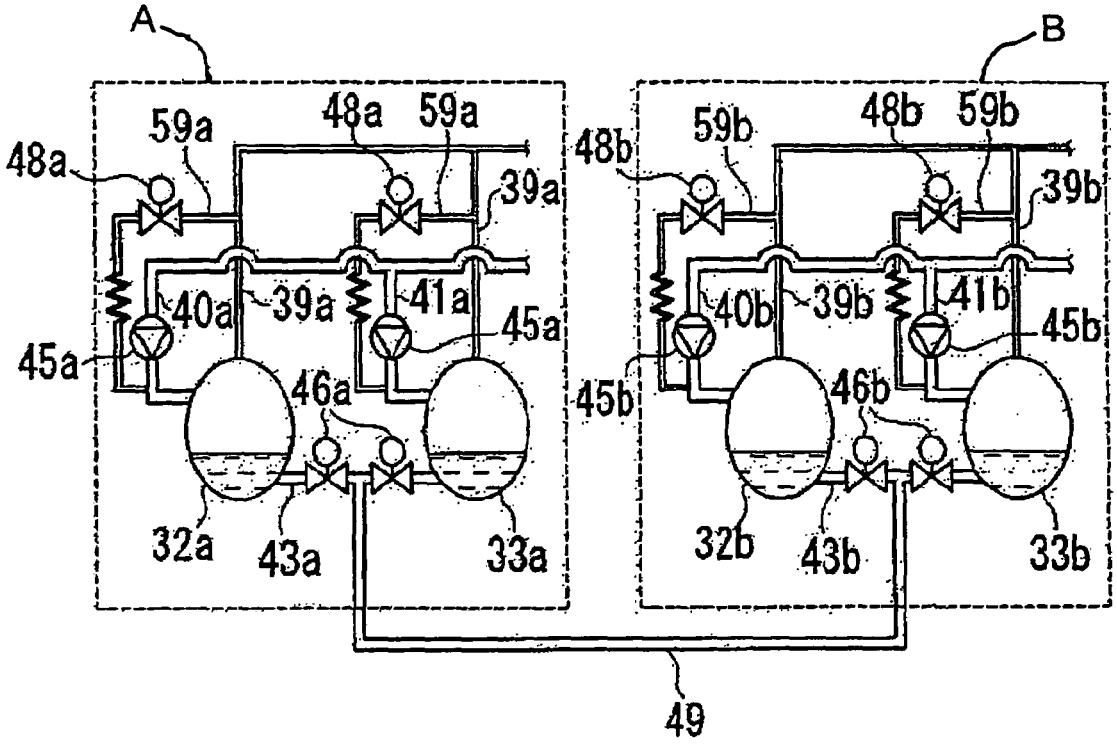
Fig 21 (PRIOR ART)
FIG. 21 is a schematic view illustrating a part of a conventional air conditioner.

As a result, lubricant oil is moved from the first compressor 2*b* to the second compressor 3*b*, as indicated by arrow S39 in FIG. 20, thus increasing the oil level of the second compressor 3*b*.

Thereafter, it is determined at operation S41 whether the oil level of the second compressor 3*b* is not higher than the predetermined level. If the determination corresponds to "YES", the procedure proceeds to operation S42. On the other hand, if the determination corresponds to "NO", the procedure returns to operation S10 of FIG. 12.

At operation S42, a control operation is executed to operate the first and second compressors 2*b* and 3*b* in the controlled operation mode, to forcibly operate the first compressor 2*a*, and to stop the second compressor 3*a*. In this case, only the first opening/closing valve 16*a* is opened, whereas the remaining opening/closing valves are maintained in a closed state.

As a result, lubricant oil is moved from the second compressor 3*a* to the first compressor 2*a*, as indicated by arrow S42 in FIG. 20, thus increasing the oil level of the first compressor 2*a*.

Operation S44 is then executed. At operation S44, a control operation is executed to stop the first compressors 2*a* and 2*b* and to forcibly operate the second compressors 3*a* and 3*b*. In this case, the first opening/closing valve 16*a* and third opening/closing valve 18*b* are closed, whereas the remaining opening/closing valves are opened. The condition established at operation S44 is maintained for a predetermined time at operation S45.

As a result, lubricant oil is moved from the first compressor 2*a* to the second compressor 3*b*, as indicated by arrow S44 in FIG. 20, thus increasing the oil level of the second compressor 3*b*.

Thereafter, it is determined at operation S46 whether the oil level of the second compressor 3*b* is not higher than the predetermined level. If the determination corresponds to "YES", the procedure proceeds to operation S47. On the other hand, if the determination corresponds to "NO", the procedure returns to operation S10 of FIG. 12.

At operation S47, a control operation is executed to stop the first compressor 2*b*, to forcibly operate the second compressor 3*b*, and to operate the first and second compressors 2*a* and 3*a* in the controlled operation mode. In this case, only the first opening/closing valve 16*b* is opened, whereas the remaining opening/closing valves are maintained in a closed state.

As a result, lubricant oil is moved from the first compressor 2*b* to the second compressor 3*b*, as indicated by arrow S47 in FIG. 20, thus increasing the oil level of the second compressor 3*b*.

Thus, even in the case of the method for performing an oil equalizing operation in accordance with the above-described liquid level detection control operation, lubricant oil is collected in the first compressors 2*a* and 2*b*, which are provided with respective check valves 15*a* and 15*b* and respective bypass tubes 29*a* and 29*b*, in accordance with the characteristics of a low-pressure shell type compressor in which a reduction in pressure occurs during operation of the compressor, through operations S16 and S19 of FIG. 17, operation S26 of FIG. 18, operations S32 and S35 of FIG. 19, and operation S42 of FIG. 20. Through operation S21 of FIG. 17, operation S28 of FIG. 18, operation S37 of FIG. 19, and operation S44 of FIG. 20, it is then possible to perform an oil equalizing operation in which the lubricant oil from the stopped compressor of one outdoor unit is rapidly supplied into the other outdoor unit within a reduced period of time by efficiently using pressure generated by forced operation of the other compressor in the outdoor unit having one compressor stopped.

Also, oil equalization is achieved by feeding lubricant oil from one of the compressors connected in parallel to the other compressor through operations S23 and S31 of FIG. 18, and operations S39 and S47 of FIG. 20.

In accordance with this embodiment, therefore, the amounts of lubricant oil in all compressors 2*a*, 3*a*, 2*b*, and 3*b* are equalized within a reduced period of time, similar to the previously described embodiment. Thus, a reliable and efficient oil system is implemented. Accordingly, the restriction on the length and diameter of pipes is reduced. Also, there is no problem caused by different levels of the constituent elements of the air conditioner. Therefore, it is possible to achieve a widened freedom of design including installation of outdoor units. Moreover, it is only necessary to install a check valve (check valve 15*a* or 15*b*) and a bypass tube (bypass tube 29*a* or 29*b*) in one compressor (first compressor 2*a* or 2*b*) of each outdoor unit (outdoor unit 1*a* or 1*b*). Accordingly, it is unnecessary to install such elements in all compressors, as in conventional air conditioning units. Thus, a reduction in costs is achieved in accordance with a reduction in the number of constituent elements used in the air conditioner.

In particular, in accordance with the method for performing an oil equalizing operation, using the liquid level detection control operation, it is possible to reliably supply lubricant oil into compressors, which preferably require a supply of lubricant oil due to the lowering of the liquid level during operation. Accordingly, there is an advantage in that efficient oil equalization can be achieved.

The present invention is not limited to the above-described embodiments. For example, connections, which are connected to the bypass tubes 29*a* and 29*b* of the air conditioner upstream from the bypass tubes 29*a* and 29*b*, are not limited to the oil return tubes 14*a* and 14*b*. These connections may be any of the sections through which high pressure gas or high pressure liquid passes, such as the discharge pipes 9*a* and 9*b* or the uppermost parts of the liquid collectors 7*a* and 7*b*, as long as the sections are at the side of the first compressors 2*a* and 2*b*.

As is apparent from the above description, in accordance with one aspect of the present invention, it is basically necessary to install a bypass tube, a bypass opening/closing valve, and a check valve only in one compressor of each outdoor unit. Thus, a reduction in factors causing failure is achieved. Accordingly, the costs may be reduced because an improvement in the reliability of the system is achieved in accordance with the reduction in factors causing failure. When the bypass opening/closing valve is opened during operation of the other compressor of each outdoor unit, pressure from the other compressor is applied to the suction side of the one compressor via the bypass tube and suction tube. Thus, it is possible to pressurize lubricant oil in the oil reservoir of the one compressor, using the applied pressure, and thus, to feed the lubricant oil to another outdoor unit via a connecting tube. Therefore, it is possible to reduce the time taken to complete the oil equalizing operation. Also, there is no restriction on the length of oil equalizing pipes. Therefore, it is possible to achieve a wider freedom of design, and a reduction in costs.

In accordance with another aspect of the present invention, it is possible to feed lubricant oil from one of the compressors, connected in parallel, to the other compressor, using a simple operation to stop the one compressor. Thus, it is possible to reliably and inexpensively achieve oil equalization, using a simple operation to stop a desired compressor.

In accordance with another aspect of the present invention, it is possible to reliably and efficiently achieve oil equalization during a normal operation mode because the oil equalization can be performed by efficiently using the discharge pressure of the other one of the compressors connected in parallel.

In accordance with another aspect of the present invention, it is possible to uniformly supply all compressors, and thus, to more effectively perform an oil equalizing operation.

In accordance with another aspect of the present invention, it is possible to achieve oil equalization, using a simple operation, and thus, to easily manage the oil equalizing operation.

In accordance with another aspect of the present invention, the oil equalization can be achieved without the user being aware because it is unnecessary to use detectors during a normal controlled operation. Accordingly, it is possible to easily manage the oil equalizing operation by controlling the air conditioner such that the oil equalizing operation is appropriately performed prior to the normal controlled operation. Thus, reliable oil equalization can be achieved.

In accordance with another aspect of the present invention, it is possible to efficiently achieve oil equalization because it is possible to reliably supply lubricant oil into compressors, which preferentially require supply of lubricant oil.

Although a few embodiments of the present general inventive concept have been shown and described, it will be appreciated by those skilled in the art that changes may be made in these embodiments without departing from the principles and spirit of the invention, the scope of which is defined in the appended claims and their equivalents.

What is claimed is:

1. An air conditioner comprising:

a plurality of outdoor units connected in parallel with an indoor unit, each of the outdoor units comprising a plurality of compressors connected in parallel, the compressors being connected by an oil equalizing tube to feed surplus oil in each of the compressors to the remaining compressors, and a connecting tube to connect the oil equalizing tubes of the outdoor units, wherein each of the outdoor units further comprises a check valve arranged at a suction tube connected to one of the compressors included in each outdoor unit, a bypass tube arranged at an outlet of at least one of the remaining compressors, and a bypass opening/closing valve arranged in the bypass tube, wherein the bypass tube is connected to the suction tube downstream from the check valve, wherein an oil equalizing tube opening/closing valve is arranged in the oil equalizing tube of each outdoor unit to cut off flow of lubricant oil through the oil equalizing tube, and wherein a connecting tube opening/closing valve is arranged in the connecting tube.

2. The air conditioner according to claim 1, wherein each of the compressors is a low-pressure shell type compressor in which an internal pressure of a shell of the compressor during an operation of the compressor is lower than an internal pressure of the shell in a stopped state of the compressor.

3. The air conditioner according to claim 1, comprising an oil equalization controller.

4. The air conditioner according to claim 3, wherein the oil equalization controller comprises:

a timer;

an opening/closing controller to control opening/closing of the bypass opening/closing valve, the oil equalizing tube opening/closing valves, and the connecting tube opening/closing valves; and a compressor controller to control operations of the compressors.

5. A method for performing an oil equalizing operation in an air conditioner including a plurality of outdoor units connected in parallel with an indoor unit, each of the outdoor units including a plurality of compressors connected in parallel, the compressors being connected by an oil equalizing tube to feed surplus oil in each of the compressors to the remaining compressors, and a connecting tube to connect the oil equalizing tubes of the outdoor units, comprising:

collecting lubricant oil in one compressor of one of the outdoor units;

pressurizing the collected lubricant oil by a discharge pressure of another compressor, which is connected in parallel to said one compressor in the same outdoor unit; and feeding the pressurized lubricant oil to one compressor of another outdoor unit via an oil equalizing tube and a connecting tube to achieve oil equalization.

6. The method of claim 5, wherein each of the compressors is a low-pressure shell type compressor in which an internal pressure of a shell of the compressor during an operation of the compressor is lower than an internal pressure of the shell in a stopped state of the compressor.

7. A method for performing an oil equalizing operation in an air conditioner including a plurality of outdoor units connected in parallel with an indoor unit, each of the outdoor units including a plurality of compressors connected in parallel, the compressors being connected by an oil equalizing tube to feed surplus oil in each of the compressors to the remaining compressors, and a connecting tube to connect the oil equalizing tubes of the outdoor units, comprising:

collecting lubricant oil in one of the compressors in one of the outdoor units, which can apply, to an oil reservoir in the compressor, a discharge pressure of another compressor in the same outdoor unit;

pressurizing the collected lubricant oil by the discharge pressure of said another compressor in the same outdoor unit, and feeding the pressurized lubricant oil to one compressor of another outdoor unit via an oil equalizing tube and a connecting tube; and feeding lubricant oil among the compressors of the same outdoor unit.

8. The method according to claim 7, wherein oil equalization is performed by sequentially supplying lubricant oil into the compressors of the outdoor units by collecting lubricant oil in one of the compressors in one of the outdoor units, which can apply, to an oil reservoir in the compressor, a discharge pressure of another compressor in the same outdoor unit, pressurizing the collected lubricant oil by the discharge pressure of said another compressor in the same outdoor unit, and feeding the pressurized lubricant oil to one compressor of another outdoor unit via an oil equalizing tube and a connecting tube, and feeding lubricant oil among the compressors of the same outdoor unit.

9. The method according to claim 8, wherein oil equalization is performed by incorporating, in a controlled operation of the air conditioner, an oil equalizing operation to sequentially supply lubricant oil into the compressors, the oil equalizing operation comprising collecting lubricant oil in one of the compressors in one of the outdoor units, which can apply, to an oil reservoir in the compressor, a discharge pressure of another compressor in the same outdoor unit, pressurizing the collected lubricant oil by the discharge pressure of said another compressor in the same outdoor unit, and feeding the pressurized lubricant oil to one compressor of another outdoor unit via an oil equalizing tube and a connecting tube, and feeding lubricant oil among the compressors of the same outdoor unit.

10. The method according to claim 8, wherein the oil equalization is performed, starting from the collection of lubricant oil, when it is detected that an oil level in the oil reservoir of a particular one of the compressors is lower than a predetermined level.

11. A method for performing an oil equalizing operation in an air conditioner including a plurality of outdoor units connected in parallel with an indoor unit, each of the outdoor units comprising a plurality of compressors connected in parallel, the compressors being connected by an oil equalizing tube to feed surplus oil in each of the compressors to the remaining compressors, and a connecting tube to connect the oil equalizing tubes of the outdoor units, each of the outdoor units further including a bypass tube connected to a discharge tube of the outdoor unit, the bypass tube communicating with a suction tube of one of the compressors in the outdoor unit only at an outlet of said one compressor, a bypass opening/closing valve arranged in the bypass tube, a check valve arranged at the suction tube upstream from a connection between the bypass tube and the suction tube, an oil equalizing tube opening/closing valve arranged in the oil equalizing tube of the outdoor unit to cut off flow of lubricant oil through the oil equalizing tube, and a connecting tube opening/closing valve arranged in the connecting tube, wherein oil equalization is performed by:

collecting lubricant oil in the compressor, which includes the discharge tube connected with the bypass tube;

applying, to the collected lubricant oil, a discharge pressure of another compressor, which is connected in parallel to said one compressor in the same outdoor unit, via the bypass tube opened by the bypass opening/closing valve, and the suction tube preventing a reverse flow therethrough by the check valve, thereby pressurizing the collected lubricant oil; and feeding the pressurized lubricant oil to one compressor of another outdoor unit via the oil equalizing tube opened by the oil equalizing tube opening/closing valve and the connecting tube opened by the connecting tube opening/closing valve.

12. The method of claim 11, wherein the outdoor units comprise an oil equalization controller.

13. The method of claim 12, wherein the oil equalization controller comprises:

a timer;

an opening/closing controller to control opening/closing of the bypass opening/closing valve, the oil equalizing tube opening/closing valves, and the connecting tube opening/closing valves; and a compressor controller to control operations of the compressors.

14. The method of claim 12, wherein the oil equalization controller comprises a compressor liquid level detector.

15. The method of claim 12, comprising starting the oil equalization when the compressor liquid level detector detects that an oil level in the oil reservoir of a particular one of the compressors is lower than a predetermined level.

16. The method of claim 14, wherein the liquid level detector comprises a flow switch.

17. The method of claim 11, wherein each of the compressors is a low-pressure shell type compressor in which an internal pressure of a shell of the compressor during an operation of the compressor is lower than an internal pressure of the shell in a stopped state of the compressor.

* * * * *